US009022842B2

(12) United States Patent
Tanishima et al.

(10) Patent No.: US 9,022,842 B2
(45) Date of Patent: May 5, 2015

(54) ELEVATOR APPARATUS

(75) Inventors: Makoto Tanishima, Tokyo (JP); Shinji Nakashima, Tokyo (JP); Keigo Yamamoto, Tokyo (JP); Masaji Iida, Tokyo (JP)

(73) Assignee: Mitsubishi Electric Corporation, Chiyoda-Ku,Tokyo (JP)

( * ) Notice: Subject to any disclaimer, the term of this patent is extended or adjusted under 35 U.S.C. 154(b) by 1057 days.

(21) Appl. No.: 13/063,421

(22) PCT Filed: Nov. 12, 2008

(86) PCT No.: PCT/JP2008/003267

§ 371 (c)(1),
(2), (4) Date: Mar. 10, 2011

(87) PCT Pub. No.: WO2010/055543

PCT Pub. Date: May 20, 2010

(65) Prior Publication Data

US 2011/0171895 A1 Jul. 14, 2011

(51) Int. Cl.
*B66B 11/02* (2006.01)

(52) U.S. Cl.
CPC ..... *B66B 11/0226* (2013.01); *B66B 11/024* (2013.01)

(58) Field of Classification Search
CPC ..... B66B 11/024; B66B 11/0226
USPC ..... 454/68
See application file for complete search history.

(56) References Cited

U.S. PATENT DOCUMENTS 1,033,963 A * 7/1912 Surprise ..... 181/224
2,184,484 A * 12/1939 Bojner ..... 454/234
2,398,627 A * 4/1946 Disbro et al. ..... 454/68
2,532,268 A * 11/1950 Christmann ..... 62/259.1
3,917,161 A * 11/1975 Nielsen ..... 236/13
4,462,459 A * 7/1984 Schmidlin ..... 165/54

(Continued)

FOREIGN PATENT DOCUMENTS

JP 3-005657 A 1/1991
JP 9-077428 A 3/1997
JP 10-182039 A 7/1998

(Continued)

OTHER PUBLICATIONS

International Search Report (PCT/ISA/210) issued on May 26, 2009, by Japanese Patent Office as the International Searching Authority for International Application No. PCT/JP2008/003267.

*Primary Examiner* — Gregory Huson
*Assistant Examiner* — Frances F Hamilton
(74) *Attorney, Agent, or Firm* — Buchanan Ingersoll & Rooney PC

(57) ABSTRACT

An elevator apparatus includes an elevator car; an air blower including an air inlet and an air outlet; ducts each having one end individually connected to the elevator car, the air inlet and the air outlet; intake and exhaust air volume adjusting means having the other end of each of the ducts connected thereto, which adjusts an intake and exhaust volume of air in the elevator car by varying a volume of air that bypasses the car to flow from the air outlet to the air inlet of the air blower; and control means that controls the intake and exhaust air volume adjusting means, to adjust air pressure within the car to set air pressure. The elevator apparatus adjusts air pressure within the elevator car, even when there is a small differential pressure between the set air pressure within the car and an air pressure outside the car.

14 Claims, 33 Drawing Sheets

(56) References Cited

U.S. PATENT DOCUMENTS

| | | | | |
|---|---|---|---|---|
| 5,031,514 | A * | 7/1991 | Kice | 454/250 |
| 5,460,570 | A * | 10/1995 | Okamura et al. | 454/68 |
| 5,962,787 | A * | 10/1999 | Okada et al. | 73/514.32 |
| 7,267,203 | B2 * | 9/2007 | Sekimoto | 187/393 |
| 7,762,875 | B2 * | 7/2010 | Sekimoto | 454/68 |
| 2001/0009209 | A1 * | 7/2001 | Kobayashi et al. | 187/266 |
| 2010/0267322 | A1 * | 10/2010 | Yamamoto et al. | 454/68 |

FOREIGN PATENT DOCUMENTS

| | | | | |
|---|---|---|---|---|
| JP | 10226477 | A * | 8/1998 | B66B 11/02 |
| JP | 11-171409 | A | 6/1999 | |
| JP | 2004-010286 | A | 1/2004 | |
| JP | 2004-256192 | A | 9/2004 | |

* cited by examiner

ELEVATOR APPARATUS

TECHNICAL FIELD

The present invention relates to elevator apparatuses that include means for making adjustment of air pressure within an elevator car.

BACKGROUND ART

A conventional elevator apparatus includes an elevator car that moves upward and downward; an air blower that includes an air inlet and an air outlet; a duct that connects the interior space of the elevator car to the air inlet and the air outlet of the air blower; a switch valve provided within the duct, which makes switching between the connection of the interior space of the elevator car and the air inlet of the air blower and the connection of the interior space of the car and the air outlet of the blower; and an inverter device that controls a rotational speed of a motor that drives the air blower, in which the elevator apparatus makes switching, according to the upward and downward movement of the elevator car, between the connection of the interior space of the elevator car and the air inlet of the air blower and the connection of the interior space of the car and the air outlet of the blower and also varies the rotational speed of the motor using the inverter device, whereby the volume of air flowing into and discharged from the air blower is increased or decreased to make adjustment of the air pressure within the car, and a variation rate of the air pressure within the car that varies with the upward and downward movement of the car is controlled so as to be made small (refer to Patent Document 1, for example).

[Patent Document 1]

Japanese Unexamined Patent Application Publication No. H10-182039 (page 5, FIGS. 11 and 12)

DISCLOSURE OF INVENTION

Problem that the Invention is to Solve

In the conventional elevator apparatus as described above, the inverter device varies the rotational speed of the air blower that draws air into the elevator car or exhausts air from the car, to increase and reduce intake and exhaust air volume of the blower thereby adjusting air pressure within the car; however, when the motor that causes the air blower to turn rotates at a rotational speed lower than a certain rotational speed, the motor does not allow a fan of the air blower to turn owing to its smaller rotational torque, thus disabling the air blower from drawing or discharging an air volume of a predetermined value or less. As a result, a problem with the elevator apparatus is that air pressure within the car cannot be adjusted when there is a small differential pressure between set air pressure within the car and air pressure thereoutside.

The present invention is directed to overcome the above problem, and provides an elevator apparatus that enables adjustment of air pressure within an elevator car even when there is a small differential pressure between set air pressure within the car and air pressure thereoutside.

Means for Solving the Problem

An elevator apparatus according to the present invention comprises an elevator car that moves upward and downward; an air blower that includes an air inlet and an air outlet; a plurality of ducts each having one end individually connected to the elevator car, the air inlet and the air outlet; intake and exhaust air volume adjusting means having the other end of each of the plurality of ducts connected thereto, which make adjustment of an intake and exhaust volume of air within the elevator car by varying a volume of air that bypasses the elevator car to flow from the air outlet to the air inlet; and control means that controls the intake and exhaust air volume adjusting means, to make adjustment of air pressure within the elevator car to set air pressure.

Advantageous Effects of the Invention

According to the present invention, the air pressure within an elevator car can be adjusted even when there is a small differential pressure between the set air pressure within the car and the air pressure outside the car, and therefore an elevator apparatus can be provided that reduces passenger's uncomfortableness more effectively.

REFERENCE NUMERALS

Figure 1:
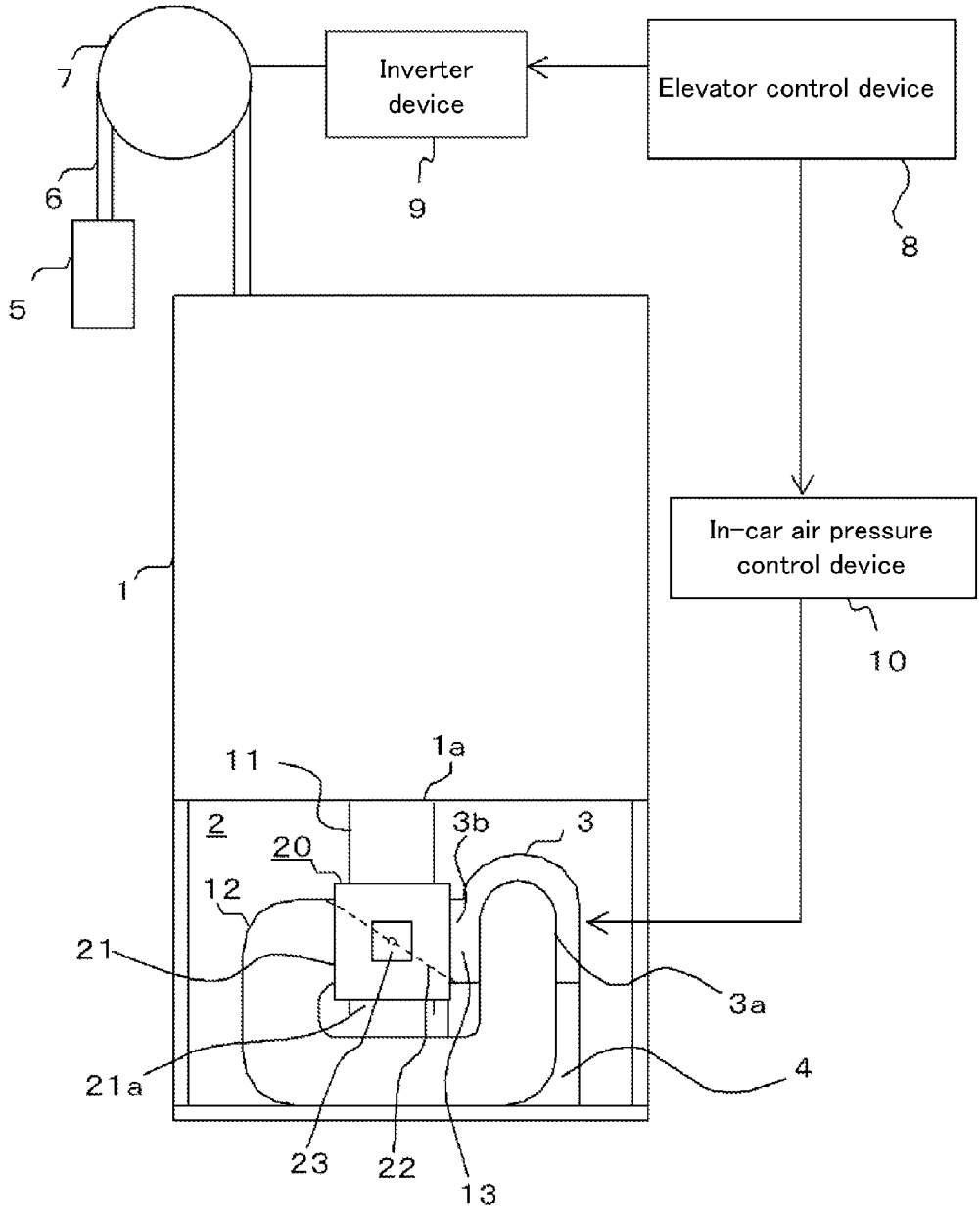
FIG. 1 is a schematic view illustrating a configuration of an elevator apparatus according to Embodiment 1 of the present invention.

1 elevator car
3 air blower
3*a* air inlet
3*b* air outlet
8*a* elevator operation monitoring means
8*b* door full close time measuring means
10 in-car air pressure control device (control means)
11-13 duct
20 and 30 intake and exhaust air volume adjusting means
21 and 31 casing
22 air volume adjusting plate (space separation means)
23 and 33 motor (drive means)
32 air volume adjusting box (space separation means)
40, 50 and 70 airtight sealing mechanism (airtight sealing means)
72 open and close valve
74 ventilation fan (fan)
80 device for entering and exiting an elevator car (door)

BEST MODE FOR CARRYING OUT THE INVENTION

Embodiment 1

Figure 2:
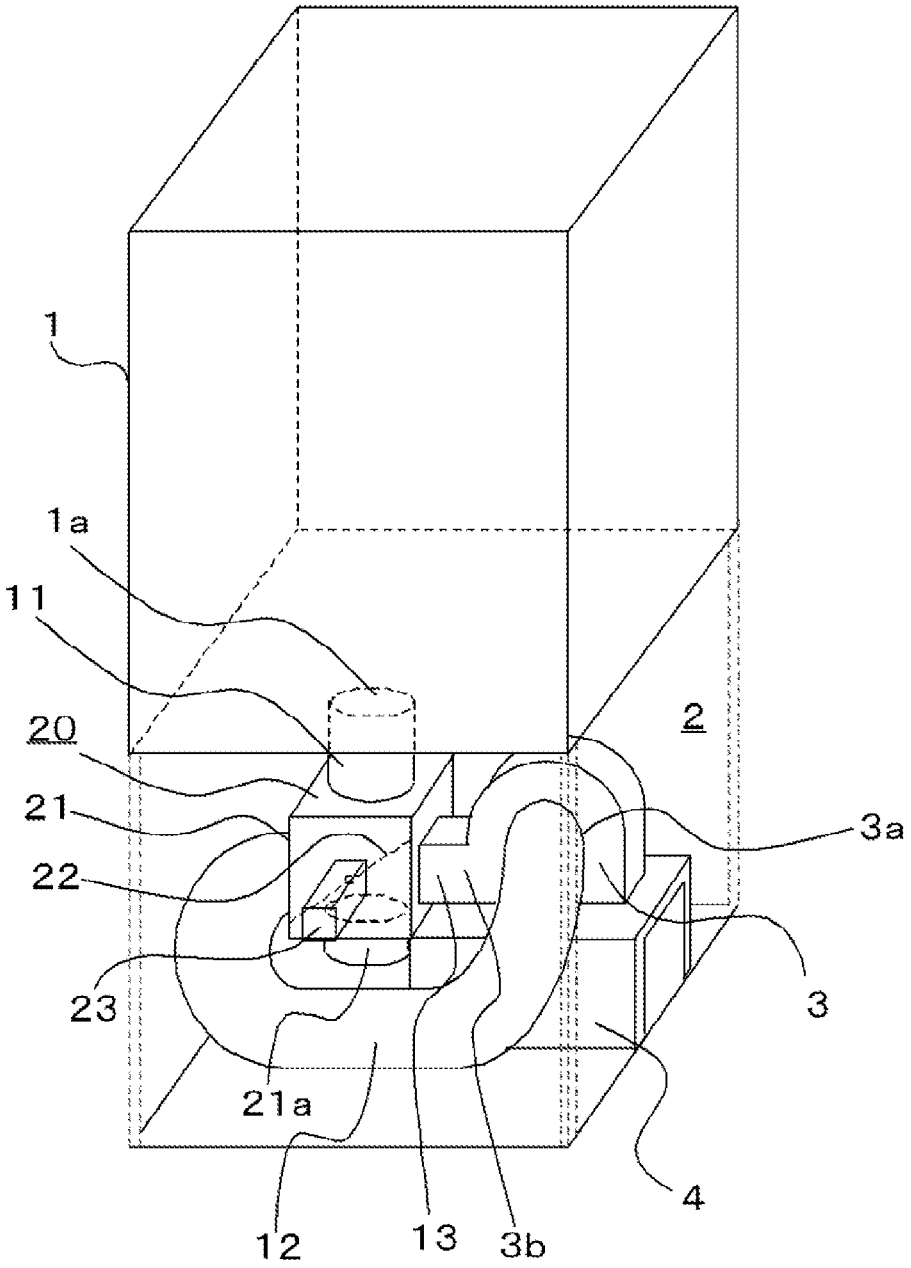
FIG. 2 is a perspective view illustrating the configuration of the elevator apparatus according to Embodiment 1 of the present invention.
Figure 8:
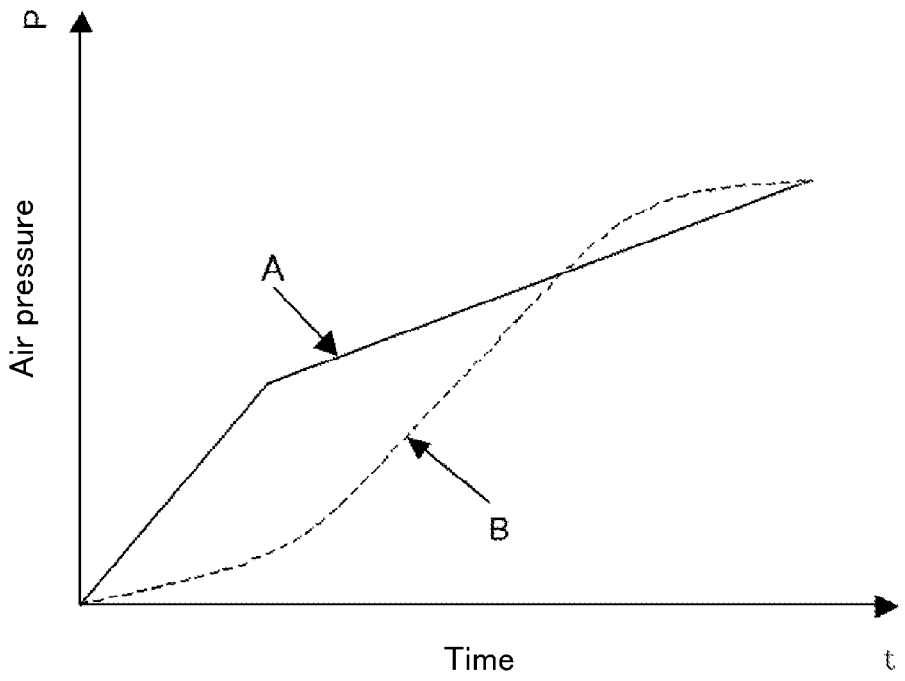
FIG. 8 is a graph illustrating variations of set air pressure within the car and air pressure thereoutside during the downward movement of the car according to Embodiment 1 of the present invention.
Figure 9:
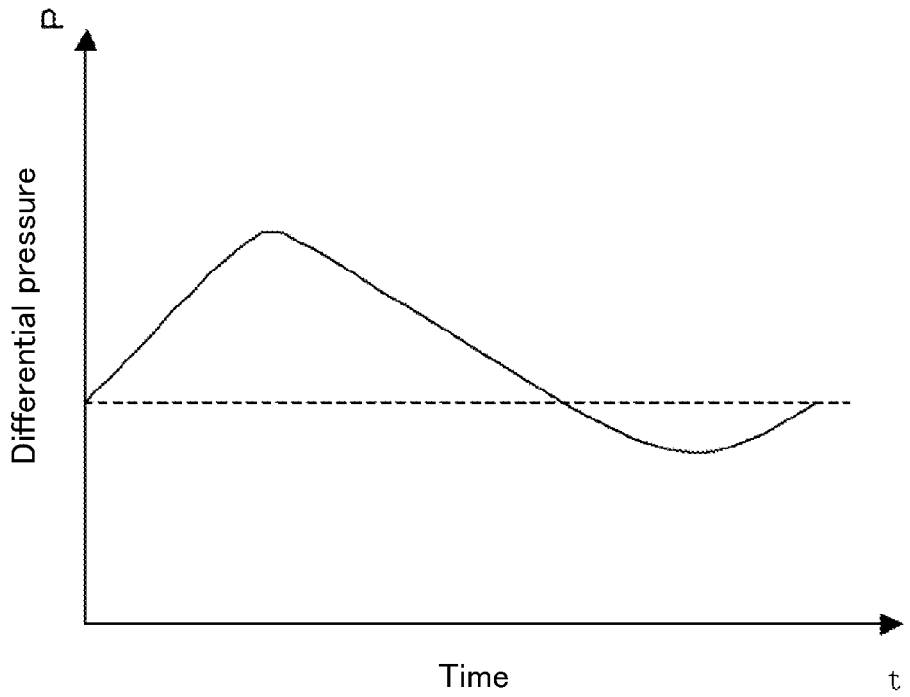
FIG. 9 is a graph illustrating a differential pressure between the set air pressure within the car and the air pressure thereoutside, shown in FIG. 8.
Figure 10:
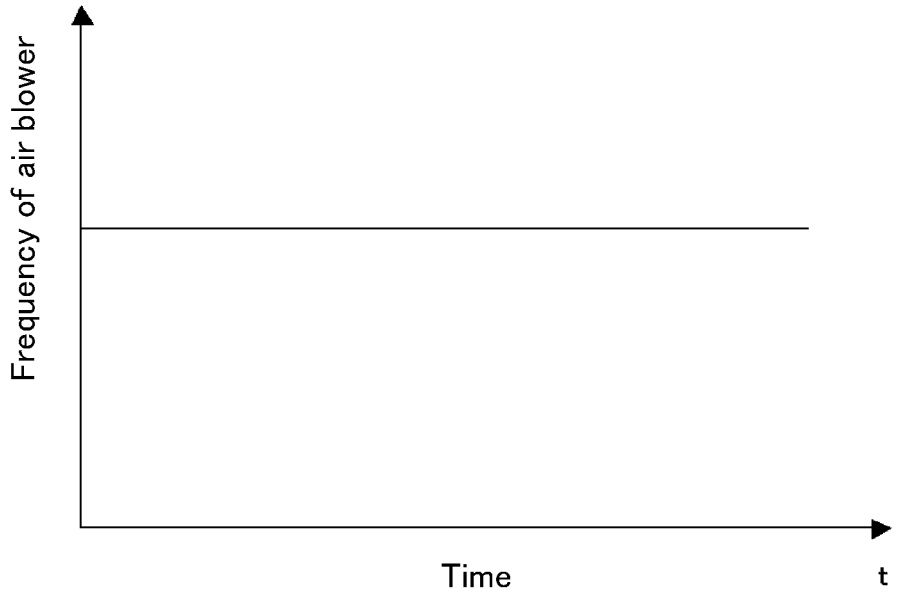
FIG. 10 is a graph illustrating a variation in rotational speed of an air blower provided in the elevator apparatus according to Embodiment 1 of the present invention.
Figure 11:
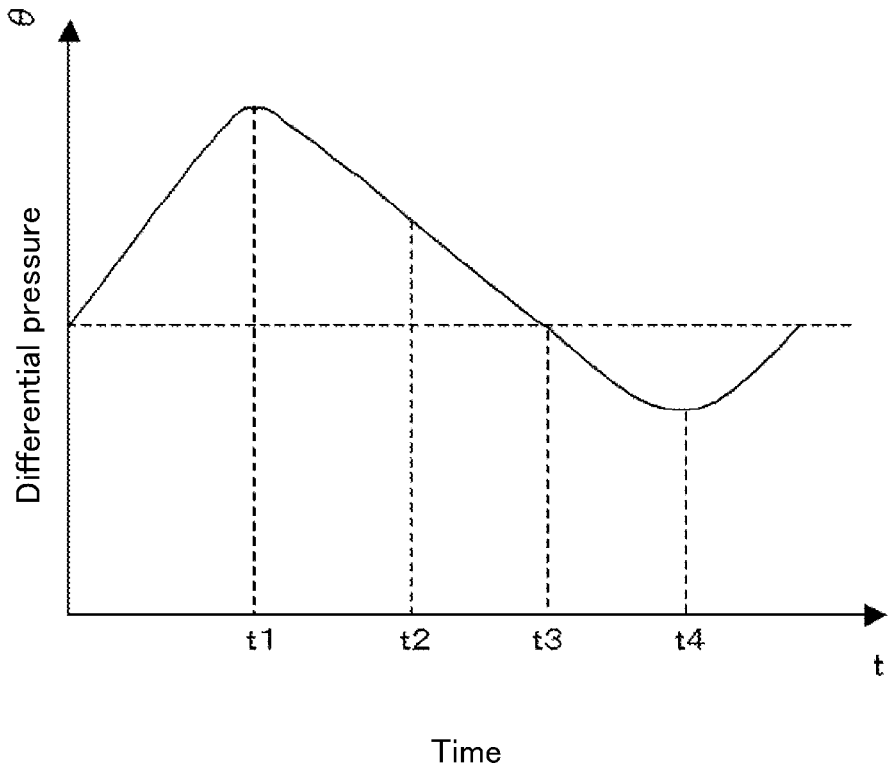
FIG. 11 is a graph illustrating an angular variation of an air volume adjusting plate provided in the elevator apparatus according to Embodiment 1 of the present invention.
Figure 12:
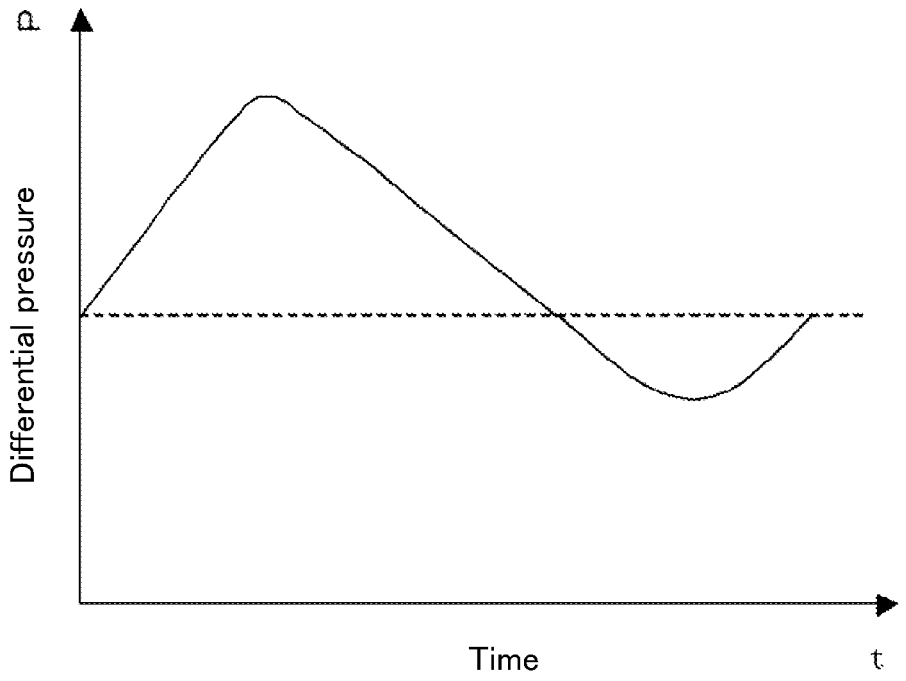
FIG. 12 is a graph illustrating a variation in differential pressure between air pressures within and outside the car of the elevator apparatus according to Embodiment 1 of the present invention.
Figure 13:
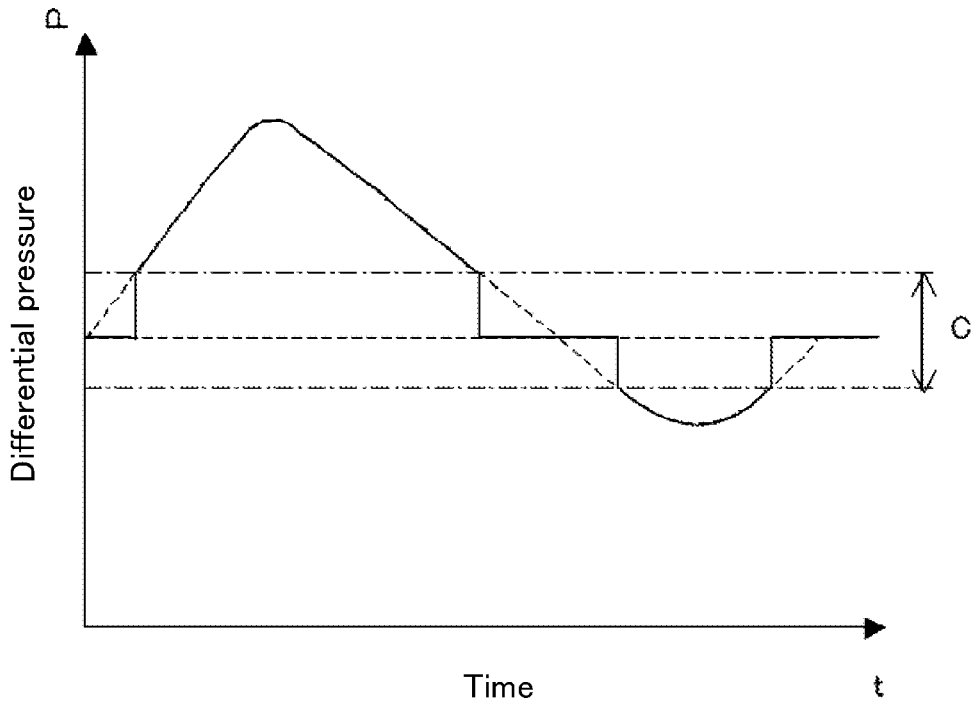
FIG. 13 is a graph illustrating a variation in differential pressure between air pressures within and outside an elevator car of a conventional elevator apparatus.

FIGS. 1 and 2 are a schematic view and a perspective view, respectively, illustrating an configuration of an elevator apparatus according to Embodiment 1 of the present invention, FIGS. 3 through 7 being side views each illustrating an operation of the elevator apparatus according to Embodiment 1 of the present invention. Further, FIG. 8 is a graph illustrating variations of set air pressure within an elevator car and air pressure thereoutside during downward movement of the car according to Embodiment 1 of the present invention; FIG. 9 is a graph illustrating a differential pressure between the set air pressure within an elevator car and the air pressure thereoutside, in FIG. 8; FIG. 10 is a graph illustrating a variation in rotational speed of an air blower provided in the elevator apparatus according to Embodiment 1 of the present invention; FIG. 11 is a graph illustrating an angular variation of an air volume adjusting plate provided in the elevator apparatus according to Embodiment 1 of the present invention; FIG. 12 is a graph illustrating a variation in differential pressure between air pressures within and outside the car of the elevator apparatus according to Embodiment 1 of the present invention; and FIG. 13 is a graph illustrating a variation in differential pressure between air pressures within and outside an elevator car of a conventional elevator apparatus.

First of all, the configuration of the elevator apparatus according to Embodiment 1 will be described with reference to FIGS. 1 and 2.

Referring to FIG. 1, the elevator apparatus comprises an elevator car 1 that moves upward and downward, and an air pressure adjusting device 2 that makes adjustment of air pressure within the elevator car 1. Further, provided on the bottom surface of the car 1 is an interior air intake and exhaust port 1*a*, which is connected via a duct 11 to the air pressure adjusting device 2.

The air pressure adjusting device 2 is configured with an air blower 3 having an air inlet 3*a* and an air outlet 3*b*, and intake and exhaust air volume adjusting means 20 connected to the interior air intake and exhaust port 1*a* of the elevator car 1, the air inlet 3*a* and the air outlet 3*b* by way of respective ducts 11 through 13, and the air blower 3 is mounted on a mount 4.

The intake and exhaust air volume adjusting means 20 is configured with a casing 21 that is connected with the above ducts 11 through 13 and also provided with an opening 21*a* in communication with space outside the casing, an air volume adjusting plate 22 that is space separation means provided rotatably within the casing 21, and a motor 23 that is drive means that drives the air volume adjusting plate 22. The inner space of the casing 21 is separated by the air volume adjusting plate 22 into a first space in communication with a space within the elevator car 1, and a second space in communication with the opening 21*a*. The duct 12 and the duct 13, and the duct 11 and the opening 21*a* are connected to respective opposite sides of the casing 21; a rotational shaft 22*a* is provided perpendicularly to sides to which any one of the ducts 11 through 13 is not connected and on which the opening 21*a* is not formed. Further, the connection ports where the casing 21 is connected to the ducts 12 and 13 are formed rectangular in shape, and both ends of the air volume adjusting plate 22 is disposed to protrude into the ducts 12 and 13.

The elevator car 1 is moved upward and downward by operating a traction machine 7 to raise a rope 6 having a counter-balance weight 5 attached on its one end. The moving speed of the elevator car 1 is controlled by varying a rotational speed of the traction machine 7 using an inverter device 9 based on a signal from an elevator control device 8, and then an in-car air pressure control device 10, which is control means, sends to the motor 23 a control signal that controls the rotational angle according to the upward and downward travel of the car 1.

In FIGS. 1 and 2, although provided on the bottom of the car 1, the air pressure adjusting device 2 may be provided on the top thereof, and the interior air intake and exhaust port 1*a* of the elevator car 1 may be provided on the top or side thereof.

Next, a basic operation of the elevator apparatus according to the present embodiment will be described with reference to FIGS. 3 through 7. Note that arrows shown in FIGS. 3 through 7 each represent an air flow, and the air blower 3 rotates at a uniform rotational speed in the present embodiment.

Figure 3:
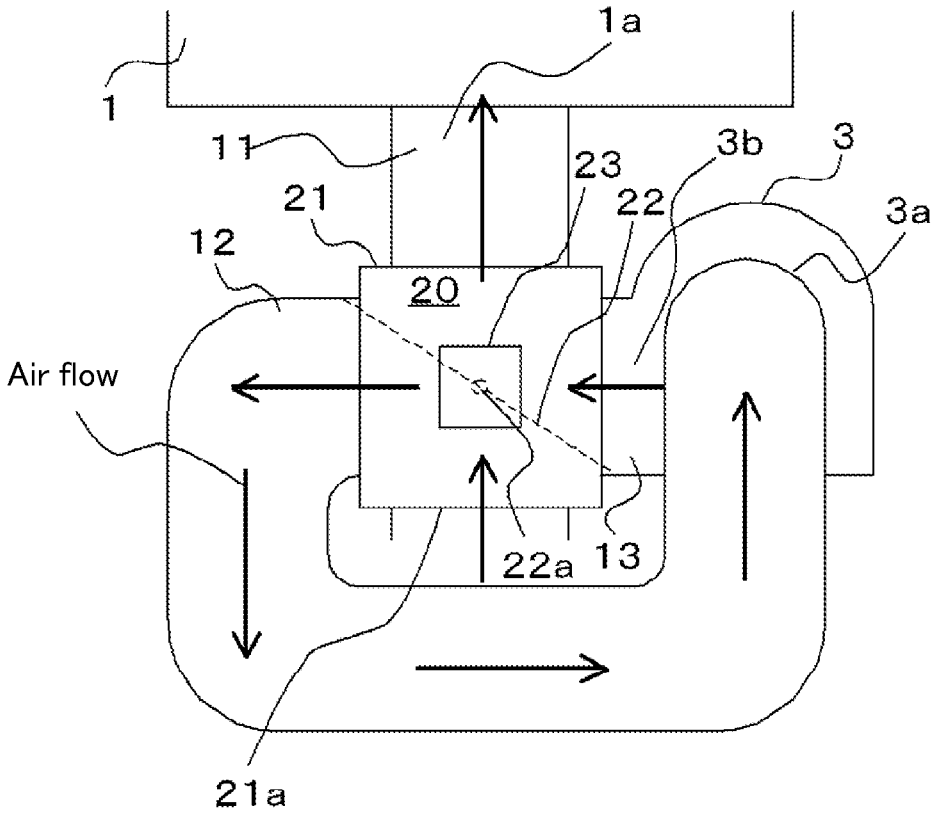
FIG. 3 is a side view illustrating an operation of the elevator apparatus during a time in which air (large air intake volume) is drawn into an elevator car according to Embodiment 1 of the present invention.

FIG. 3 is a side view illustrating an operation in which a maximum volume of air is drawn into the elevator car 1. As shown in FIG. 3, when the maximum volume of air is drawn into the car 1, the motor 23 causes the air volume adjusting plate 22 to rotate thereby forming the first space and the second space in the casing so that the air outlet 3*b* of the blower 3 and the air inlet 3*a* thereof communicate with the interior air intake and exhaust port 1*a* of the car 1 and the opening 21*a*, respectively, and the air inlet 3*a* does not communicate with the air outlet 3*b*.

When the air volume adjusting plate 22 is fixedly held at such an angle, outside air, drawn from the opening 21*a* of the intake and exhaust air volume adjusting means 20 into the casing 21, flows through the duct 12 to the air inlet 3*a* of the blower 3. Then, the air discharged from the air outlet 3*b* of the blower 3 is passed from the duct 13, through the casing 21, the duct 11 and the interior air intake and exhaust port 1*a*, into the elevator car 1. Consequently, the air pressure within the elevator car 1 is positive relative to the air pressure thereoutside.

Figure 4:
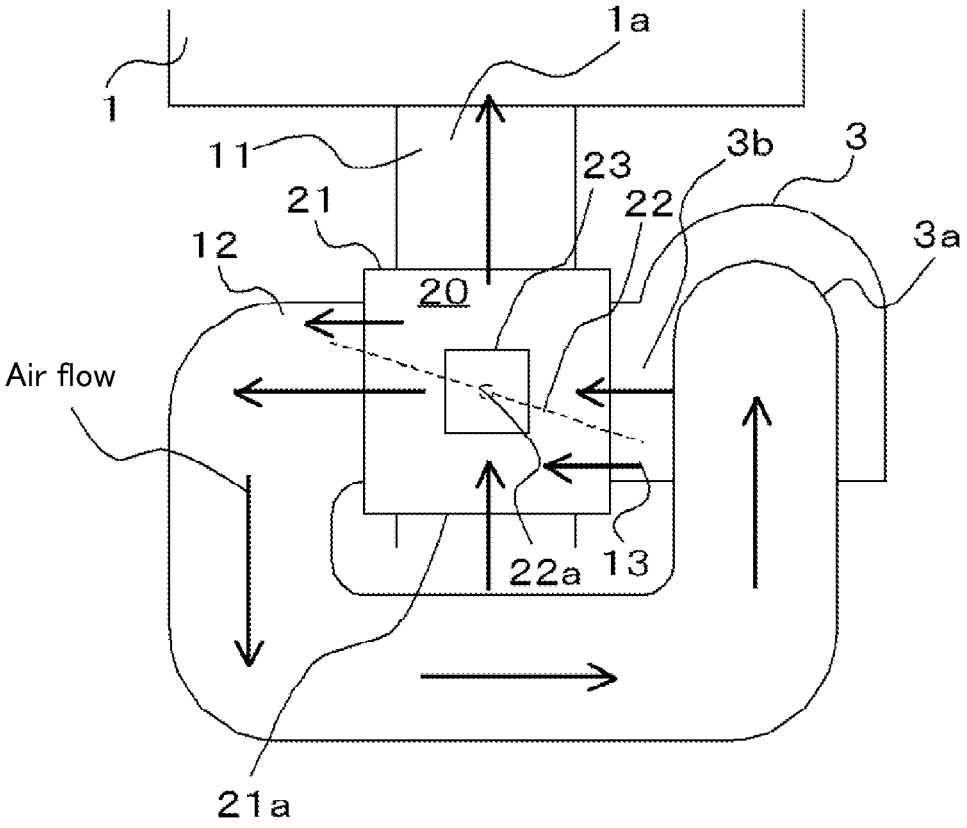
FIG. 4 is a side view illustrating an operation of the elevator apparatus during a time in which air is drawn into the car (small air intake volume) according to Embodiment 1 of the present invention.

FIG. 4 is a view illustrating an operation in which a volume of air less than that of FIG. 3 is drawn into the elevator car 1. Referring to FIG. 4, the air volume adjusting plate 22, which is slightly rotated counter-clockwise from the angular position shown in FIG. 3, is controlled in terms of its angular position so that conductance of air through a passage where the first space communicates with the air outlet 3*b* of the air blower 3 is greater than that where the first space communicates with the air inlet 3*a* of the air blower 3, and conductance of air through a passage where the second space communicates with the air inlet 3*a* is greater than that where the second space communicates with the air outlet 3*b* of the blower 3. By adjusting the air volume adjusting plate 22 at such an angle and forming the first space and the second space in the casing, the air discharged from the air outlet 3*b* of the blower 3 not only flows from the interior air intake and exhaust port 1*a* into the elevator car 1, but also bypasses the car 1 to flow, by way of the duct 12, the blower 3 and the duct 13, directly to the air inlet 3*a*. For that reason, the volume of air that flows from the blower 3 into the elevator car 1 becomes less in comparison to the example of FIG. 3.

Figure 5:
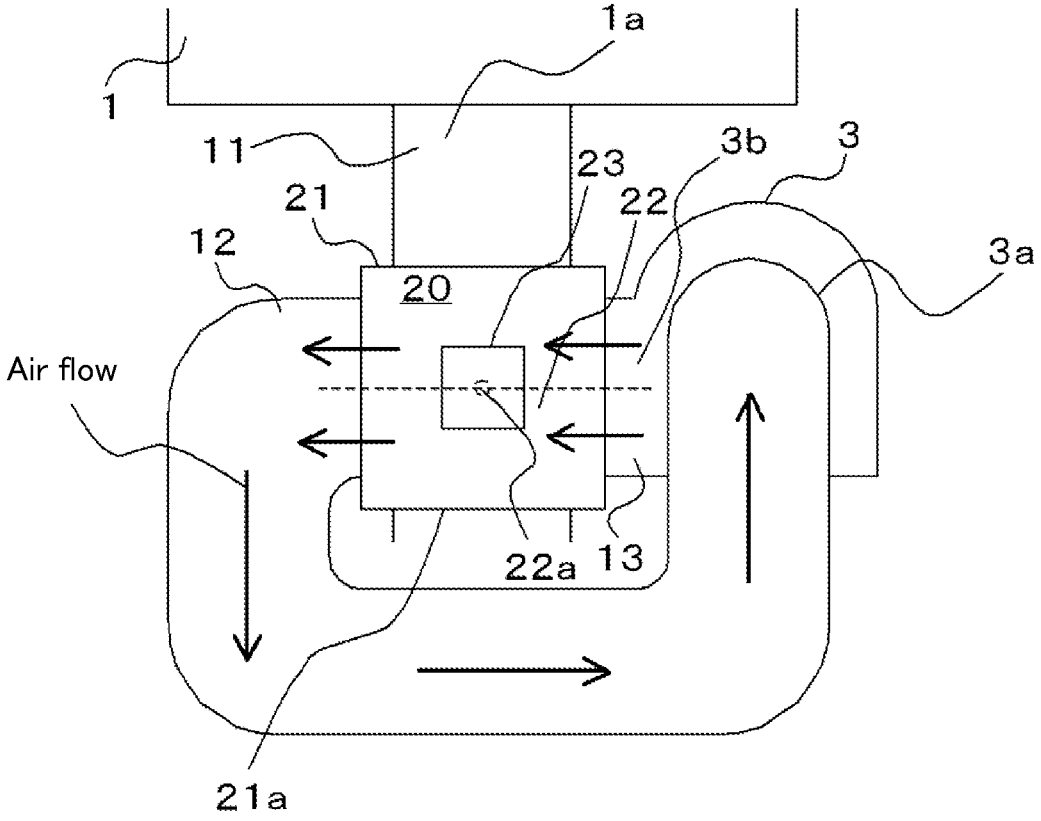
FIG. 5 is a side view illustrating an operation of the elevator apparatus in which no air is drawn into the car or exhausted therefrom according to Embodiment 1 of the present invention.

FIG. 5 is a view illustrating an operation in which no air is drawn into the elevator car 1 or exhausted therefrom. The motor 23 controls the angular position of the air volume adjusting plate 22 so that the plate 22 is held horizontally. In the present embodiment, the volume of air from the air blower 3 and the sectional area and length of the duct 11 are determined so that, when the air volume adjusting plate 22 is fixedly held horizontally, air pressure at a location where the duct 11 is connected to the intake and exhaust air volume adjusting means 20 is equal to the air pressure within the elevator car 1. Thus, all the volume of the air discharged from the air outlet 3*b* of the blower 3 passes through the casing 21 into the duct 12, and is drawn into the air inlet of the blower 3. In this way, the air exhausted from the blower 3 only circulates through the ducts and no air is not drawn into the car 1 or exhausted therefrom, thus resulting in no variation in air pressure within the car 1.

Figure 6:
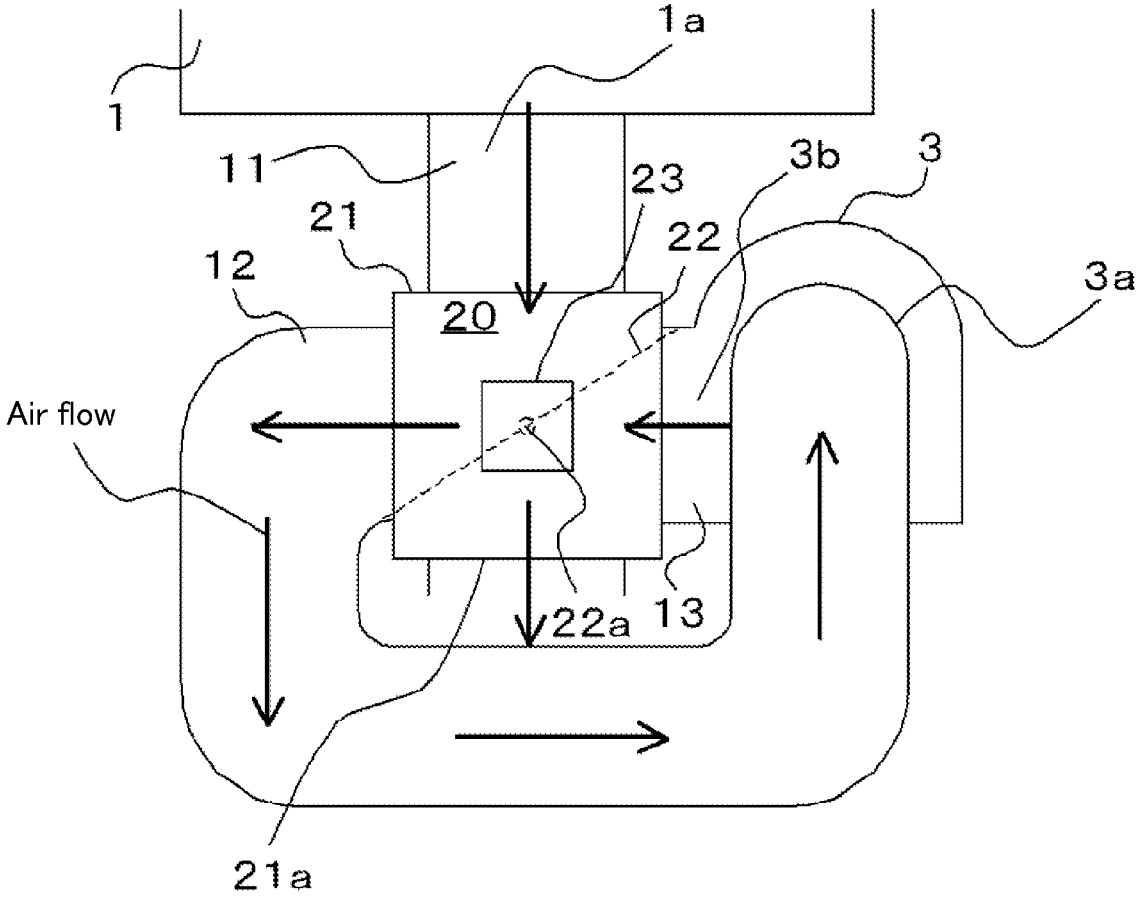
FIG. 6 is a side view illustrating an operation of the elevator apparatus during a time in which the air (large air exhaust volume) is exhausted from the car according to Embodiment 1 of the present invention.

FIG. 6 is a view illustrating an operation in which the maximum volume of air within the elevator car 1 is exhausted therefrom. As shown in FIG. 6, when the air within the car 1 is exhausted therefrom at the maximum volume rate, the motor 23 causes the air volume adjusting plate 22 to rotate thereby forming a first space and a second space in the casing so that the air inlet 3*a* of the blower 3 and the interior air intake and the air outlet 3*b* of the blower 3 communicate with the exhaust port 1*a* of the car 1 and the opening 21*a*, respectively, and the air inlet 3*a* thereof does not communicate with the air outlet 3*b* thereof.

When the air volume adjusting plate 22 is fixedly held at such an angle, the air within the elevator car 1 flows from the interior air intake and exhaust port 1*a*, through the duct 11, the casing 21 and the duct 12, to the air inlet 3*a* of the blower 3. Then, the air discharged from the air outlet 3*b* of the blower 3 is exhausted from the duct 13 through the casing 21 and the opening 21*a* into the outside atmosphere. Consequently, the air pressure within the car 1 is negative relative to the air pressure outside the car 1.

Figure 7:
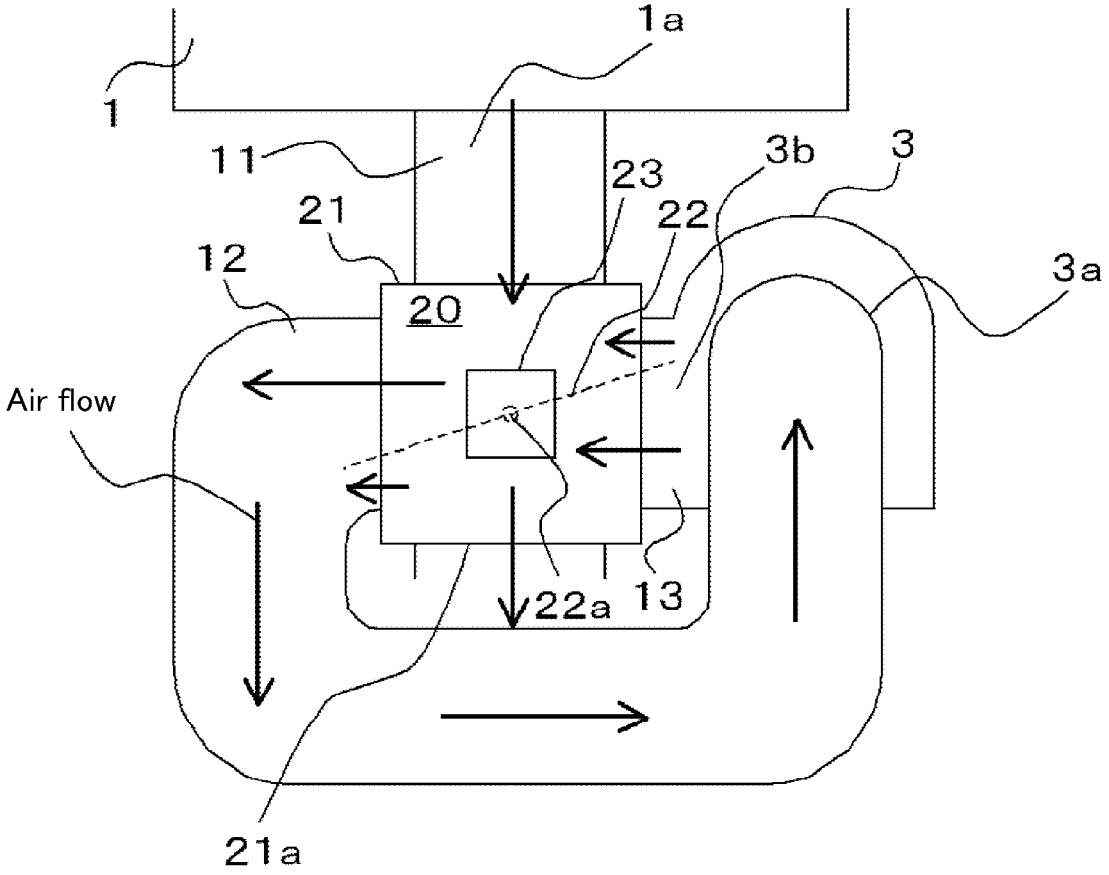
FIG. 7 is a side view illustrating an operation of the elevator apparatus during a time in which the air (small air exhaust volume) is exhausted from the car according to Embodiment 1 of the present invention.

FIG. 7 is a view illustrating an operation in which a volume of air less than that of FIG. 6 is exhausted from within the elevator car 1. Referring to FIG. 7, the air volume adjusting plate 22 is slightly rotated clockwise from the position shown in FIG. 6 and is controlled in terms of its angular position so that the conductance of air through the passage where the first space communicates with the air outlet 3*b* is smaller than that where the first space communicates with the air inlet 3*a* of the blower 3, and the conductance of air through the passage where the second space communicates with the air inlet 3*a* is smaller than that where the second space communicates with the air outlet 3*b* of the blower 3. By adjusting the air volume adjusting plate 22 at such an angle and forming the first space and the second space in the casing, not only the air within the car 1 but also the air discharged from the air outlet 3*b* of the blower 3 is drawn into the air inlet 3*a*. For that reason, the volume of air that is exhausted from within the car 1 becomes less in comparison to the example of FIG. 6.

In this way, the air volume adjusting plate 22 is rotated to vary the conductance of air through the passage where the first space communicates with the air inlet 3*a* of the blower 3 in synchronism with the conductance of air through the passage where the second space communicates with the air outlet 3*b* of the blower 3, and thereby to vary the volume of air that bypasses the elevator car 1 and flows from the outlet 3*b* of the blower 3 directly to the inlet 3*a* thereof, whereby switching between drawing air from the outside of the elevator car 1 thereinto and exhausting the air therewithin to the outside thereof can be made and the intake air volume into the car 1 and the exhaust air volume therefrom can also be arbitrarily adjusted.

Next, an operation of adjusting air pressure within the elevator car 1 will be described with reference to FIGS. 8 through 13.

In FIG. 8, a curve shown in dotted lines represents a change curve of air pressure outside the car 1, and varies with an S-shaped curve, according to the variation in the descent speed of the car 1. When no adjustment of the air pressure within the car 1 is made, the air pressure therewithin varies along these dotted lines B. On the other hand, in FIG. 8, a curve shown in a solid line A represents a change curve of set air pressure within the car 1, according to the present embodiment, in which the air pressure within the car 1 is varied at two different rates. FIG. 9 is a curve showing a differential pressure between the solid line A (the set air pressure within the car) and the dotted lines B (air pressure outside the car) showing in FIG. 8. In order to vary the air pressure within the car 1 along the solid line A (the set air pressure within the car), the air pressure adjusting device 2 needs to be controlled so as to increase and decrease the air pressure within the car 1 by the differential pressure as shown in FIG. 9.

FIG. 10 and FIG. 11 show temporal variations for performing this control operation, of the rotational speed of the air blower 3 and of the rotational angle of the air volume adjusting plate 22, respectively. Note that, referring to FIG. 11, the angular position of the air volume adjusting plate 22 is defined as zero degree when the air volume adjusting plate 22 is oriented in the horizontal direction as shown in FIG. 5, and a clockwise direction is defined as a positive direction and a counter-clockwise direction as a negative direction.

As shown in FIG. 10, the rotational speed of the blower 3 according to the present embodiment stays constant, while the rotational angle of the air volume adjusting plate 22 is controlled, as shown in FIG. 11, by the control means so as to be an angle corresponding to the change curve of the differential pressure as shown in FIG. 9. In FIG. 11, the angles of the air volume adjusting plate 22 at times t1 through t3 correspond to those shown in FIGS. 3 through 5, respectively, and the angle thereof at a time t4, to that shown in FIG. 7.

In this way, the air blower 3 is rotated at a uniform rotational speed, and the air volume adjusting plate 22 is also driven to synchronously vary areas of connection ports that communicate the first and second spaces with the air inlet 3*a* of the blower 3 and the first and second spaces with the air outlet 3*b* thereof, to control the elevator apparatus, whereby a differential pressure as shown in FIG. 12 can be supplied into the elevator car 1. As a result, even if there is a small differential pressure between the set air pressure within the car 1 and the air pressure outside the car 1, the pressure therewithin can be adjusted as shown in the change curve of the set air pressure shown in FIG. 8.

Further, increasing the rotational speed of the motor 23 that drives the air volume adjusting plate 22 can accommodate a rapid variation in pressure.

On the other hand, in an apparatus, such as the conventional elevator apparatus, that makes adjustment of the air pressure within the elevator car 1 by varying only the rotational speed of the blower 3 through inverter control, the blower 3 cannot be rotated with a predetermined rotational speed or less; therefore, there is created a differential pressure range C in which the air pressure within the car 1 cannot be increased or decreased, as shown in FIG. 13. Thus, the change in pressure differential between the pressure within the car 1 and that outside the car 1 is shown in the solid line of FIG. 13, so that the air pressure within the car 1 cannot be adjusted along the change curve of the set air pressure shown in FIG. 8.

In the present embodiment, the air pressure within the car 1 is adjusted to vary at two different rates as shown in the solid line A of FIG. 8; however, the set air pressure within the car 1 is not limited to this, but can be adjusted to vary at a constant rate.

Further, in this embodiment, the method of adjusting air pressure within the car 1 during its downward movement is described; however, as with the car 1 during its downward movement, air pressure within the car 1 during its upward movement can also be adjusted.

According to the present embodiment, the elevator apparatus comprises the elevator car 1 that moves upward and downward; the air blower 3 that includes an air inlet 3*b* and an air outlet 3*a*; the plurality of ducts 11 through 13 each having one end individually connected to the car 1, the air inlet 3*b* and the air outlet 3*a*; the intake and exhaust air volume adjusting means 20 having the other end of each of the plurality of ducts 11 through 13 connected thereto, which adjusts an intake and exhaust volume of air within the car 1 by varying a volume of air that bypasses the car 1 to flow from the air outlet 3*a* to the air inlet 3*b*; and the control means 10 that controls the intake and exhaust air volume adjusting means 20, to adjust air pressure within the car 1 to set air pressure. Therefore, the air pressure can be adjusted even when there is a small differential pressure between the set air pressure within the car 1 and the air pressure thereoutside.

Further, according to the present embodiment, since the air blower 3 rotates at a uniform rotational speed, a device to be controlled for making adjustment of the air pressure within the elevator car 1 is only the motor 23 that drives the air volume adjusting plate 22, which facilitates control of the air pressure.

Embodiment 2

Figure 14:
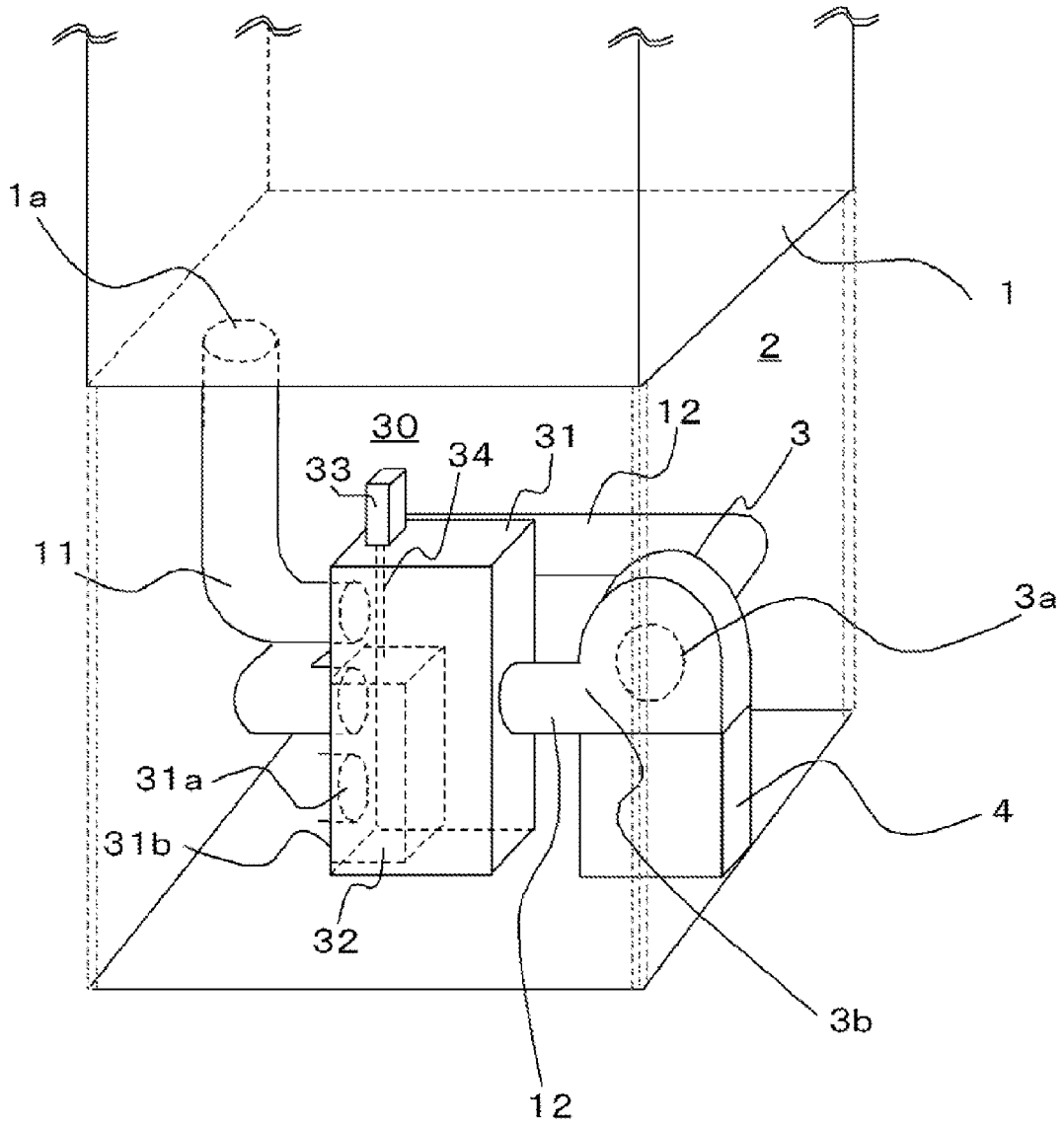
FIG. 14 is a perspective view illustrating a configuration of an elevator apparatus according to Embodiment 2 of the present invention.

FIG. 14 is a perspective view illustrating a configuration of an elevator apparatus according to Embodiment 2 of the present invention and FIGS. 15 through 19 are views each showing an operation of the elevator apparatus according to Embodiment 2 of the present invention.

First of all, the configuration of the elevator apparatus according to Embodiment 2 will be described with reference to FIG. 14. The only difference between the elevator apparatus in Embodiment 2 and the elevator apparatus in Embodiment 1 is a configuration of an intake and exhaust air volume adjusting means 30.

Referring to FIG. 14, the intake and exhaust air volume adjusting means 30 of the elevator apparatus according to the present embodiment includes a casing 31 in which the duct 11 connected to the air intake and exhaust port 1*a* of the elevator car 1 and the duct 12 connected to the inlet 3*a* of the air blower 3 are connected to the same side surface 31*b* of the casing 31 where an opening 31*a* in communication with the outside atmosphere is provided; an air volume adjusting box 32, box-shaped and serving as space separation means, that partially covers the side surface 31*b* of the casing 31 and slides upward and downward; a ball screw 34 fixed to the air volume adjusting box 32; and a motor 33 that is drive means that drives the air volume adjusting box 32 via the ball screw 34. A space within the casing 31 is separated by the air volume adjusting box 32 into a first space that is in communication with the air inlet 3*a* of the blower 3 and a second space that is in communication with the air outlet 3*b* thereof.

Here, a linear slider may be used in place of the ball screw 34 and further, an actuator can be used instead of the motor 33.

Next, a basic operation of the elevator apparatus according to Embodiment 2 will be described with reference to FIGS. 15 through 19. Note that arrows in FIGS. 15 through 19 represent air flows and the air blower 3 rotates at a uniform rotational speed in the present embodiment as well.

Figure 15:
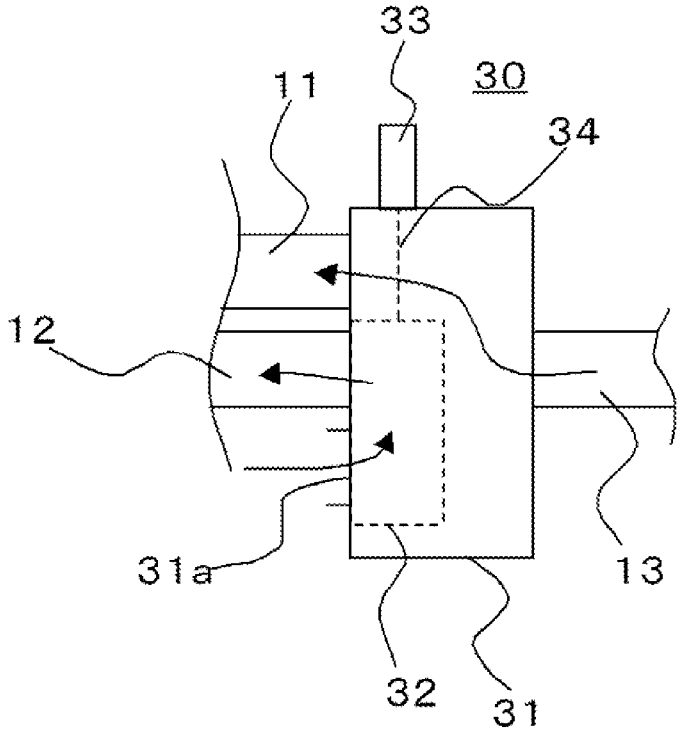
FIG. 15 is a perspective view illustrating an operation of the elevator apparatus during a time in which air is drawn into an elevator car (large air intake volume) according to Embodiment 2 of the present invention.

FIG. 15 shows an operating condition in which air is drawn into the elevator car 1. As shown in FIG. 15, during the drawing in of air, the air volume adjusting box 32 moves to its bottommost position, and the interior air intake and exhaust port 1*a* of the elevator car 1 and the opening 31*a* are connected via the ducts 11 and the ducts 12 and 13 to the air outlet 3*b* of the blower 3 and the air inlet 3*a* thereof, respectively, so that the interior air intake and exhaust port 1*a* thereof and the opening 31*a* will not communicate with the air outlet 3*b* of the blower 3 and the air outlet 3*b* thereof, respectively. The air volume adjusting box 32 is fixedly held at such a position, to form a first space and a second space, whereby the outside air is introduced from the opening 31*a* provided at the lower portion of the intake and exhaust air volume adjusting means 30, and the introduced air flows through the duct 12 into the air inlet 3*a* of the blower 3. Air discharged from the blower 3 is then sent through the intake and exhaust air volume adjusting means 30 into the elevator car 1. At this time, the air pressure within the elevator car 1 becomes positive relative to that thereoutside.

Figure 16:
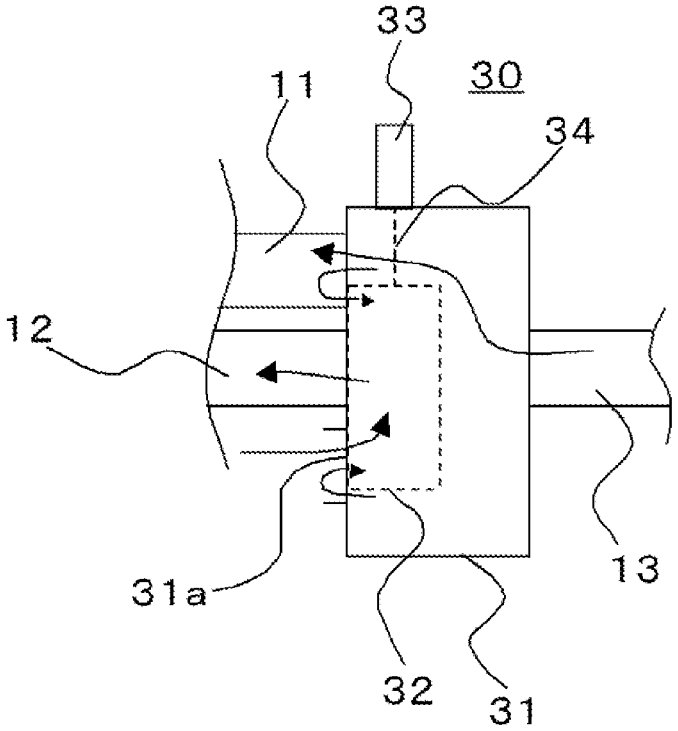
FIG. 16 is a perspective view illustrating an operation of the elevator apparatus during a time in which air (small air intake volume) is drawn into the car according to Embodiment 2 of the present invention.

FIG. 16 shows an operating condition in which the air volume adjusting box 32 is lifted upward slightly farther than that of FIG. 15; an area formed between the first space and the opening 31*a* is sized to be larger than that formed between the first space and the duct 11 connected to the space within the car 1. By fixedly holding the air volume adjusting box 32 at such a position and forming the first space and the second space, the air outlet 3*b* and the air inlet 3*a* of the blower 3 are in communication with each other; therefore, the air discharged from the air outlet 3*b* of the blower 3 not only flows into the elevator car 1, but also bypasses the car 1 and flows directly to the air inlet 3*a* of the blower 3. For that reason, the volume of air that flows into the car 1 becomes less in comparison to the example of FIG. 15.

Figure 17:
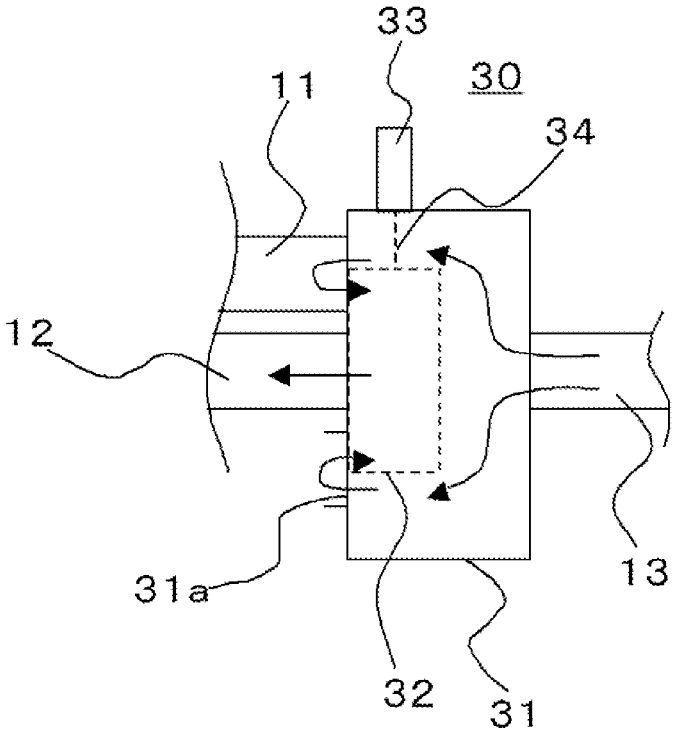
FIG. 17 is a perspective view illustrating an operation of the elevator apparatus in which no air is drawn into the elevator car or exhausted therefrom according to Embodiment 2 of the present invention.

In FIG. 17, the air volume adjusting box 32 present within the intake and exhaust air volume adjusting means 30 is in a symmetrical relation with respect to the center of the duct 12 in communication with the air inlet 3*b* of the blower 3. In the present embodiment, when the air volume adjusting box 32 is fixedly held at such a position, an air volume from the blower 3 and sectional areas and lengths of the ducts 11 through 13 are adjusted so that all the volume of air discharged from the air outlet 3*b* of the blower 3 bypasses the elevator car 1 to flow directly to the air inlet 3*a* of the blower 3; therefore, air pressure within the elevator car 1 stays unchanged.

Figure 18:
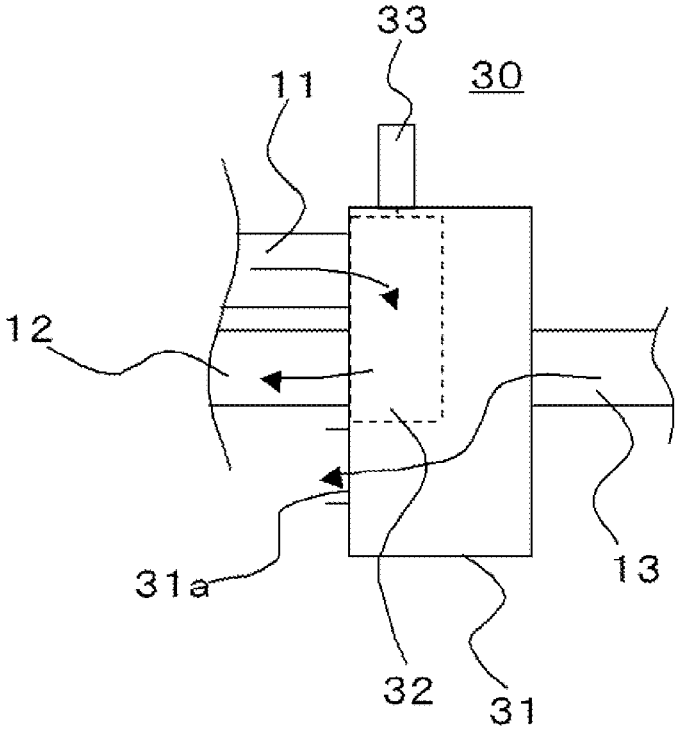
FIG. 18 is a perspective view illustrating an operation of the elevator apparatus during a time in which the air (large air exhaust volume) is exhausted from the car according to Embodiment 2 of the present invention.

FIG. 18 is a view illustrating an operating condition in which air within the elevator car 1 is exhausted therefrom. In this operation, the air volume adjusting box 32 is fixedly held at its topmost position, and the interior air intake and exhaust port 1*a* of the elevator car 1 and the outlet 3*b* of the blower 3 are in communication with the inlet 3*a* thereof and the opening 31*a*, respectively, so that the air inlet 3*a* of the blower 3 is not in communication with the air outlet 3*b* thereof. With the first space and the second space formed in this way, the air within the car 1, passing from the duct 11 through the air volume adjusting box 32, is drawn from the duct 12 into the air inlet 3*a* of the blower 3 and then exhausted from the outlet 3*b* of the blower 3 through the air volume adjusting box 32 and the opening 31*a* to the outside atmosphere. Consequently, the air pressure within the car 1 becomes negative relative to that thereoutside.

Figure 19:
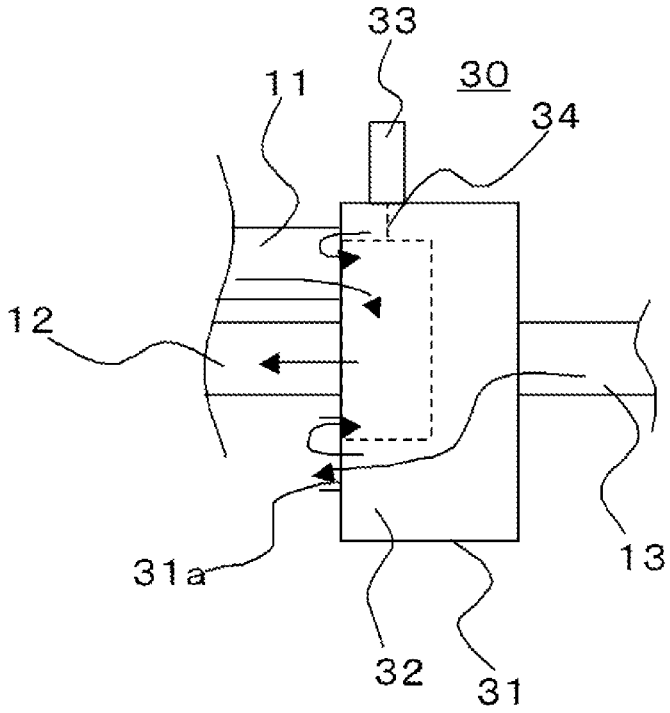
FIG. 19 is a perspective view illustrating an operation of the elevator apparatus during a time in which the air (small air exhaust volume) is exhausted from the car according to Embodiment 2 of the present invention.

FIG. 19 shows an operating condition in which the air volume adjusting box 32 is moved downward slightly farther than that of FIG. 18; an area formed between the first space and the opening 31*a* is smaller than that formed between the first space and the duct 11 connected to the space within the car 1. By fixedly holding the air volume adjusting box 32 at such a position and forming the first space and the second space, the air outlet 3*b* and the air inlet 3*a* of the blower 3 are in communication with each other; therefore, not only is the air within the elevator car 1 drawn into the air inlet 3*b* of the blower 3, but also the air discharged from the air outlet 3*b* thereof is drawn thereinto via a connection port formed between the duct 11 and the casing 31, and via the opening 31*a*. For that reason, the volume of air that flows from within the elevator car 1 into the air inlet 3*a* becomes less in comparison to the example of FIG. 18, thus resulting in less air volume exhausted from within the elevator car 1 in comparison to the example of FIG. 18.

In this way, the position of the air volume adjusting box 32 provided within the intake and exhaust air volume adjusting means 30 is controlled by the in-car air pressure control device 10, areas of connection ports that communicate the first and second spaces with the interior air intake and exhaust port 1*a* and the first and second spaces with the opening 31*a* are caused to vary in mutual synchronism, and the volume of air that bypasses the elevator car 1 to flow from the air outlet 3*a* directly to the air inlet is caused to vary, thereby allowing arbitrary adjustments of the intake air volume and the exhaust air volume within the car 1, thus enabling control of the air pressure therewithin even in an area with a small differential pressure where the conventional technique cannot adjust the air pressure. Further, in the present embodiment, because the air pressure outside the air volume adjusting box 32 is at all times higher than that therewithin, the adjusting box 32 is pressed to the left-hand side of the casing 31, which facilitates ensuring that air-tightness of the adjusting box 32 is achieved. Further, even a rapid variation in pressure can easily be accommodated by increasing the drive speed of the motor 33.

According to the present embodiment, the elevator apparatus comprises the elevator car 1 that moves upward and downward; the air blower 3 that includes an air inlet 3*b* and an air outlet 3*a*; the plurality of ducts 11 through 13 each having one end individually connected to the car 1; the air inlet 3*b* and the air outlet 3*a*; the intake and exhaust air volume adjusting means 30 having the other end of each of the plurality of ducts 11 through 13 connected thereto, which adjusts an intake and exhaust volume of air within the car 1 by varying a volume of air that bypasses the car 1 to flow from the air outlet 3*a* to the air inlet 3*b*; and the control means 10 that controls the intake and exhaust air volume adjusting means 30, to adjust air pressure within the car 1 to set air pressure. Therefore, the air pressure within the car 1 can be adjusted even when there is a small differential pressure between set air pressure within the car 1 and the air pressure thereoutside.

According to the present embodiment, since the air blower 3 rotates at a uniform rotational speed, a device to be controlled for adjusting the air pressure within the car 1 is only the motor 33 that drives the air volume adjusting plate 32, which facilitates the control operation.

Further, according to this embodiment, air-tightness between the casing 31 constituting the intake and exhaust air volume adjusting means 30 and the air volume adjusting box 32 is improved, thus enabling the rotational speed of the blower 3 to be slowed down, thereby providing a low-noise elevator apparatus with less power consumption.

Embodiment 3

Figure 20:
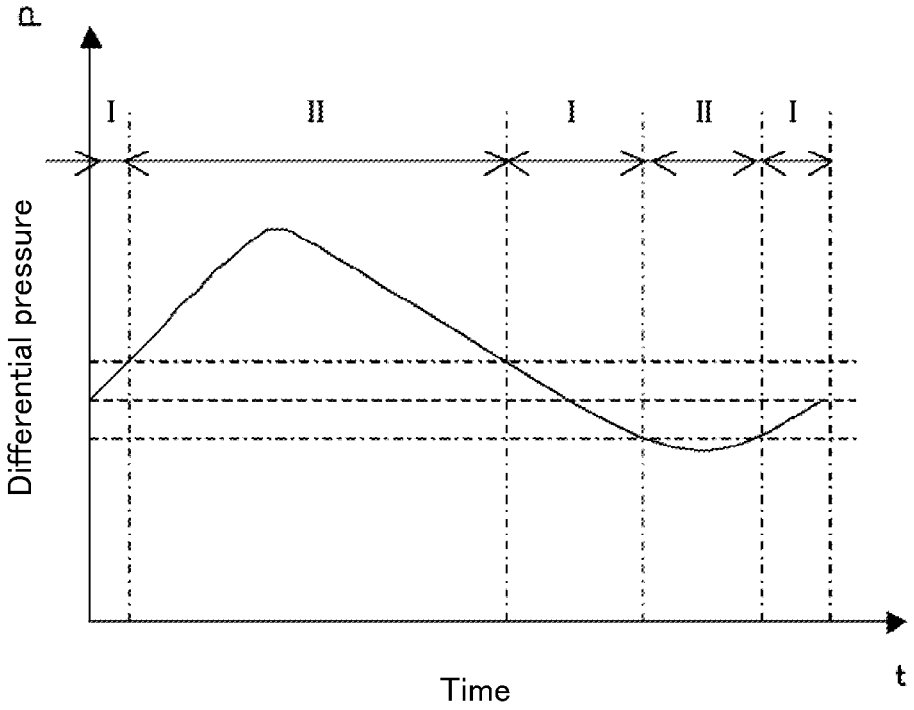
FIG. 20 is a graph illustrating a method of control of an elevator apparatus according to Embodiment 3 of the present invention.

FIG. 20 is a graph illustrating a method of control of the elevator apparatus according to Embodiment 3 of the present invention and showing timing of switching between controls of the rotational speed of the air blower and the air volume adjusting means, in a differential pressure curve similar to that in FIG. 9.

The elevator apparatus in Embodiment 3 is configured in the same fashion as that in Embodiment 1 or Embodiment 2; however, the difference is in a method of controlling the air blower 3 and the intake and exhaust air volume adjusting means 20 or 30. The elevator apparatus in Embodiment 1 or Embodiment 2 causes the air blower 3 to rotate at a uniform rotational speed, and the position of the air volume adjusting plate 22 or the air volume adjusting box 32 constituting the intake and exhaust air volume adjusting means 20 or 30, respectively, is controlled thereby controlling air pressure within the elevator car 1; however, the elevator apparatus according to Embodiment 3 controls the pressure by switching between control operations of the rotational speed of the blower 3 and of the air volume adjusting plate 22 or the air volume adjusting box 32, according to the upward and downward travel of the car 1.

As shown in FIG. 20, in a time region I where there is a low differential pressure between the set air pressure within the car 1 and the air pressure thereoutside, even if the rotational speed of the blower 3 is set to a speed corresponding to a low frequency through inverter control using the in-car air pressure control device 10, a torque of sufficient magnitude to cause the blower 3 to rotate cannot be produced. For that reason, with the air blower 3 caused to rotate uniformly at a lowest possible rotational speed, the air volume adjusting plate 22 or the air volume adjusting box 32 is controlled in the same fashion as in Embodiment 1 or Embodiment 2, to make adjustment of the air pressure within the elevator car 1. On the other hand, in a time region II where there is a great differential pressure between the set air pressure within the car 1 and the air pressure thereoutside, the air volume adjusting plate 22 or the air volume adjusting box 32 is fixedly held at the position where the maximum volume of air is drawn as shown in FIG. 3 or 15, or at the position where the maximum volume of air is exhausted as shown in FIG. 6 or 18, and the in-car air pressure control device 10 causes the rotational speed of the blower 3 to vary through inverter control, whereby the air pressure within the car 1 is controlled.

In this way, in the time region I where there is the low differential pressure between the set air pressure within the car 1 and the air pressure thereoutside, the rotational speed of the blower 3 is controlled uniformly in accordance with a minimum frequency that enables the fan to rotate and the air volume adjusting plate 22 or the air volume adjusting box 32 is also controlled, to thereby make adjustment of the air pressure within the car 1. In the time region II where there is the great differential pressure between the set air pressure within the car 1 and the air pressure thereoutside, the air volume adjusting plate 22 or the air volume adjusting box 32 is fixedly held at the position where the maximum volume of air is drawn or exhausted, and the in-car air pressure control device 10 causes the rotational speed of the blower 3 to vary through inverter control, thereby enabling an average rotational speed of the blower 3 to be reduced, enabling reduction of the power consumption of the blower 3 as well as that of the noise thereof.

According to the present embodiment, the in-car air pressure control device 10 further controls the rotational speed of the blower 3 to vary and switching between adjustment of the intake and exhaust air volume by the control of the rotational speed thereof and adjustment of the intake and exhaust air volume by the control of the intake and exhaust air volume adjusting means 20 or 30 is also made according to the differential pressure between the set air pressure within the car 1 and the air pressure thereoutside, thereby allowing reduction of the average rotational speed thereof, enabling the noise of the air blower 3 to be reduced and also enabling the power consumption thereof to be reduced.

Embodiment 4

Figure 21:
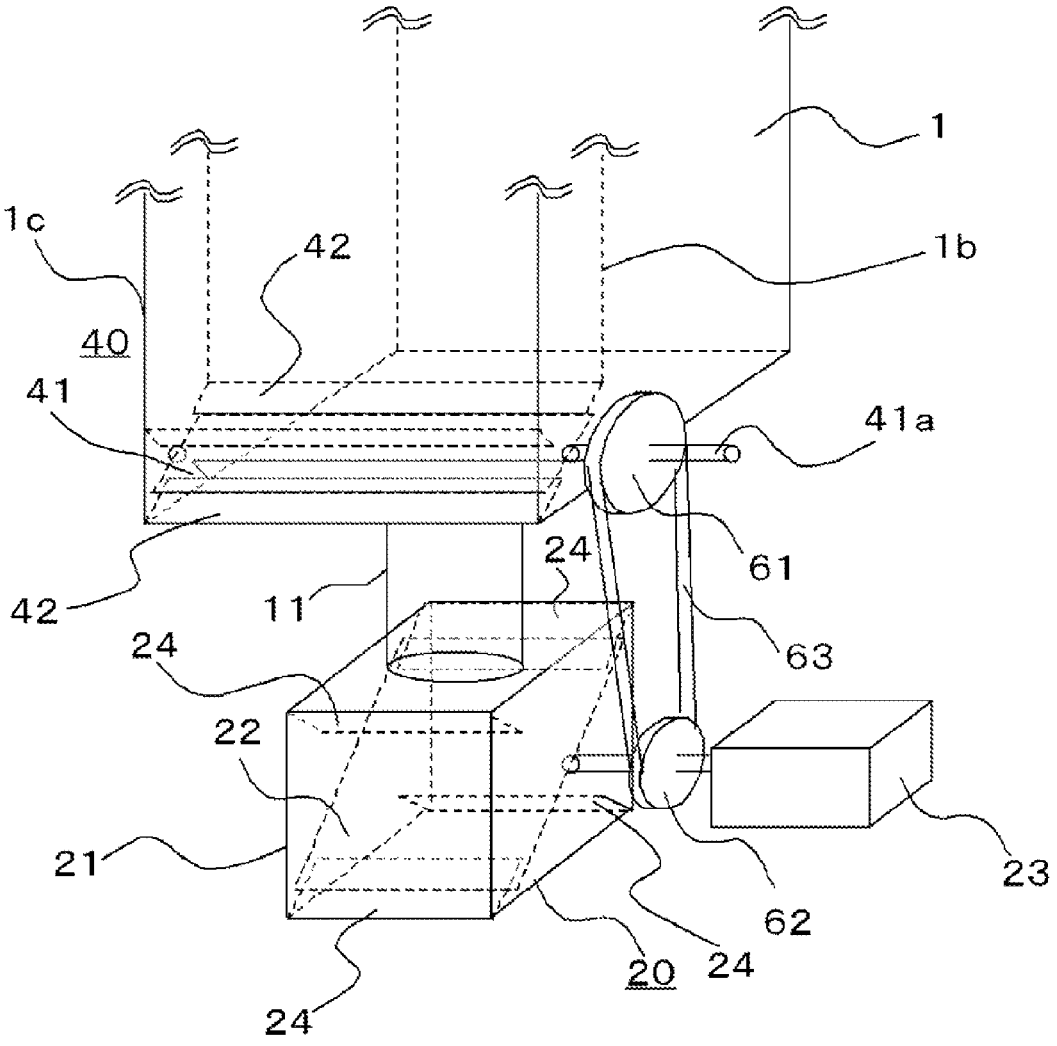
FIG. 21 is a perspective view illustrating a configuration of an elevator apparatus according to Embodiment 4 of the present invention.
Figure 22:
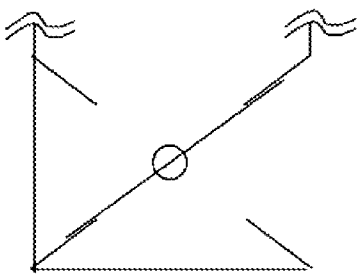
FIG. 22 is a set of cross sectional views each illustrating an operation of the elevator apparatus according to Embodiment 4 of the present invention.
Figure 22:
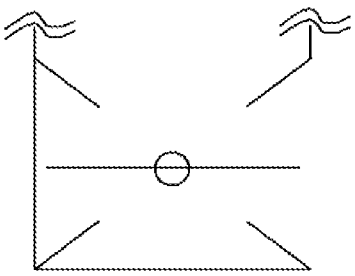
Figure 22:
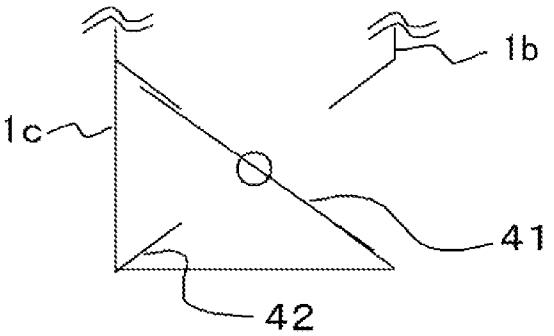
Figure 22:
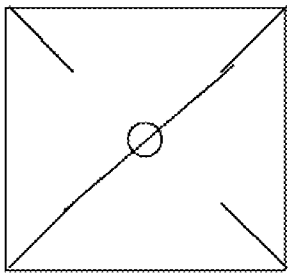
Figure 22:
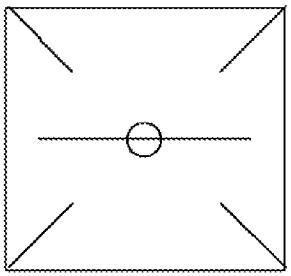
Figure 22:
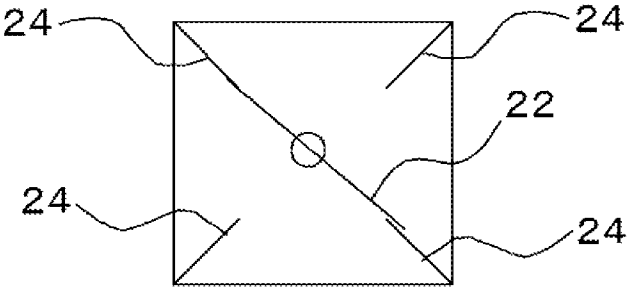
Figure 23:
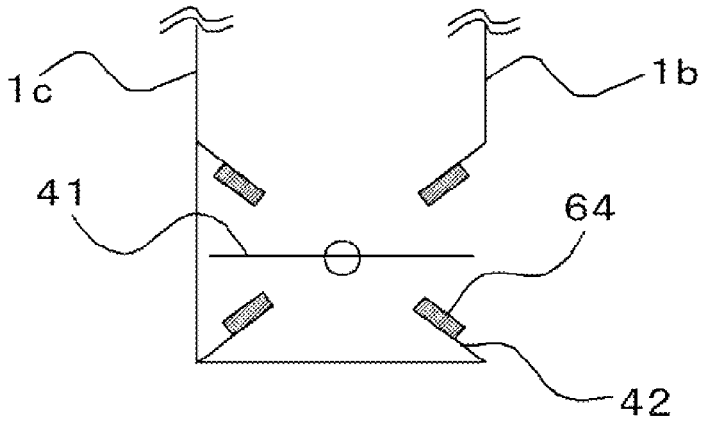
FIG. 23 is a cross sectional view illustrating an airtight sealing mechanism provided in the elevator apparatus according to Embodiment 4 of the present invention.

FIG. 21 is a perspective view illustrating a configuration of an elevator apparatus according to Embodiment 4 of the present invention. FIG. 22 is a set of cross sectional views each illustrating an operation of the elevator apparatus according to Embodiment 4 of the present invention, while FIG. 23 is a cross sectional view illustrating an airtight sealing mechanism provided in the elevator apparatus according to Embodiment 4 of the present invention.

First of all, the configuration of the elevator apparatus according to Embodiment 4 will be described with reference to FIG. 21.

In FIG. 21, the elevator apparatus is provided with an airtight sealing mechanism 40 that is airtight sealing means, in a space between an inner wall 1*b* and an outer wall 1*c* of the elevator car 1. Here, the inner wall 1*b*, located toward the side wall of the car 1 where the airtight sealing mechanism 40 is provided, is constructed with an airtight wall, and the outer wall 1*c* is constructed with a non-airtight wall, where an opening in communication with the airtight sealing mechanism 40 is provided in the bottom of the inner wall 1*b*. The airtight sealing mechanism 40 includes an airtight sealing movable plate 41 that is provided rotatably, airtight sealing stationary plates 42 provided within the airtight sealing mechanism 40 so as to abut the airtight sealing movable plate 41, and a first gear 61 mounted on a rotational shaft 41*a* of the airtight sealing movable plate 41. The sealing mechanism is provided to operate simultaneously, via a belt/chain 63, with a second gear 62 that is mounted on the rotational shaft of the intake and exhaust air volume adjusting means 20. The elevator car 1 shown in FIG. 21 is of double wall structure; the wall structure, however, is not limited to this structure and the car 1 of, for instance, single wall or triple wall structure may be used.

Further, the intake and exhaust air volume adjusting means 20 has four air volume adjusting stationary plates 24 provided within the casing 21, in addition to the air volume adjusting plate 22 provided rotatably therein. The configuration of the present embodiment is generally the same as that of Embodiment 1 except for such differences.

Next, an operation of the elevator apparatus according to Embodiment 4 with reference to FIG. 22.

FIG. 22(*a*1) is a view illustrating an operation of the airtight sealing mechanism 40 in which air is exhausted from the elevator car 1 at a maximum volume rate; FIG. 22(*a*2) is a view illustrating an operation of the intake and exhaust air volume adjusting means 20 in which the air is exhausted from the elevator car 1 at the maximum volume rate. FIG. 22(*b*1) is a view illustrating an operation of the airtight sealing mechanism 40 in which air is not drawn into the car 1 or exhausted therefrom; FIG. 22(*b*2) is a view illustrating an operation of the intake and exhaust air volume adjusting means 20 in which the air is not drawn into the car 1 or exhausted therefrom. FIG. 22(*c*1) is a view illustrating an operation of the airtight sealing mechanism 40 in which air is drawn into the car 1 at a maximum volume rate; FIG. 22(*c*2) is a view illustrating an operation of the intake and exhaust air volume adjusting means 20 in which the air is drawn into the car 1 at the maximum volume rate.

In the present embodiment, because the diameters of the first gear 61 and the second gear 62 are determined to have the same value, the air volume adjusting plate 22 and the airtight sealing movable plate 41 operate simultaneously with each other, to rotate with the same angle of rotation. Thus, when the air volume adjusting plate 22 is in an abutting relation with the air volume adjusting stationary plates 24 as shown in FIGS. 22(*a*2) and 22(*c*2), the airtight sealing movable plate 41 is in an abutting relation with the airtight sealing stationary plates 42. On the other hand, when the air volume adjusting plate 22 is not in an abutting relation with the air volume adjusting stationary plates 24 as shown in FIG. 22(*b*2), nor is the airtight sealing movable plate 41 in an abutting relation with the airtight sealing stationary plates 42 as shown in FIG. 22(*b*1).

These relations allow the elevator car 1 to be airtight during periods when the air is drawn into and exhausted from the car 1 at the maximum volume rate and to be non-airtight during times other than those periods, therefore enabling the air effectively to be drawn into the car and exhausted therefrom at the maximum volume rate and also enabling the car 1 to be ventilated during times except during the periods of the above operation.

By adjusting a ratio of diameters between the first gear 61 and the second gear 62 to make difference between the rotational speeds of the air volume adjusting plate 22 and the airtight sealing movable plate 41, timing in which the elevator car 1 becomes airtight can be adjusted as appropriate. In addition, by varying an angular position of the airtight sealing stationary plates 42, the timing in which the elevator car 1 becomes airtight can be adjusted as appropriate.

Moreover, by also providing a sealing material 64, such as rubber or sponge, to the airtight sealing stationary plates 42 of the airtight sealing mechanism 40 as shown in FIG. 23, the timing in which the elevator car 1 becomes airtight can be varied and the air-tightness within the car 1 can also be improved.

According to the present embodiment, the airtight sealing mechanism 40 that achieves air-tightness of the car 1 is further included and the air-tightness of the car 1 is thereby improved when the air is drawn into and exhausted from the car 1 at the maximum volume rate; therefore, the rotational speed of the air blower 3 can be relatively reduced, thus providing an elevator apparatus of low noise and less power consumption.

Moreover, according to the present embodiment, since the airtight sealing mechanism 40 achieves the air-tightness of the car 1 using power of the motor 23, which is means for driving the air volume adjusting plate 22, the air-tightness of the car 1 is achieved without providing separately a drive device that drives the airtight sealing movable plate 41, resulting in an elevator apparatus with less cost, less power consumption and less installation space.

Embodiment 5

Figure 24:
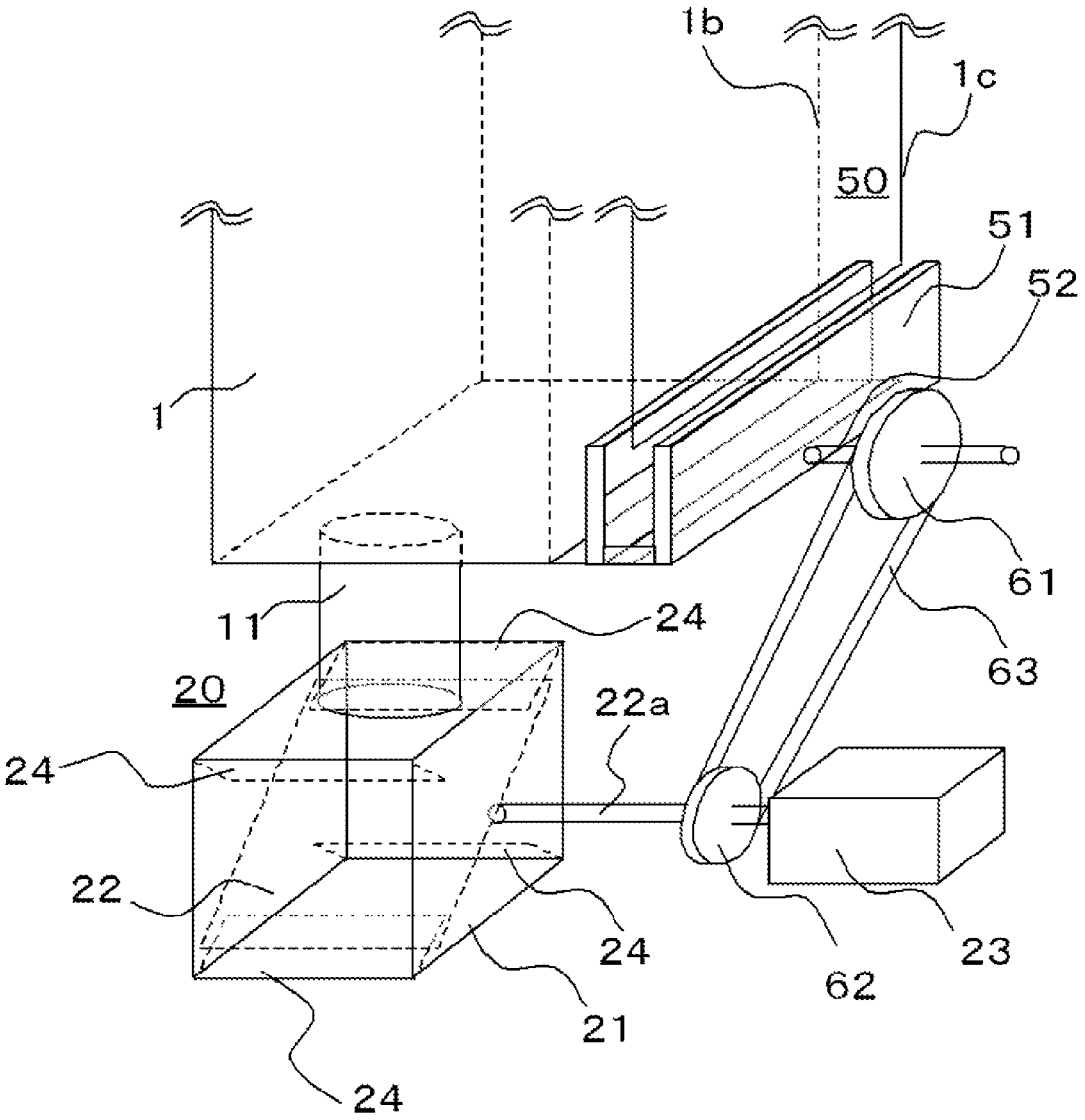
FIG. 24 is a perspective view illustrating a configuration of an elevator apparatus according to Embodiment 5 of the present invention.
Figure 25:
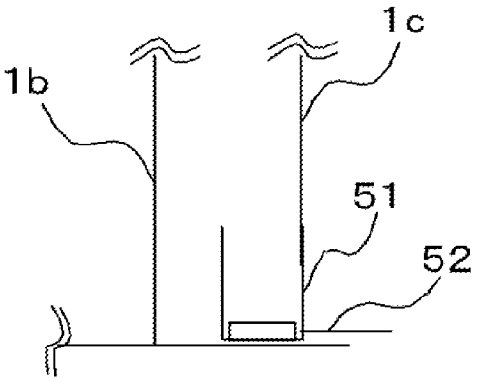
FIG. 25 is a set of cross sectional views each illustrating an operation of the elevator apparatus according to Embodiment 5 of the present invention.
Figure 25:
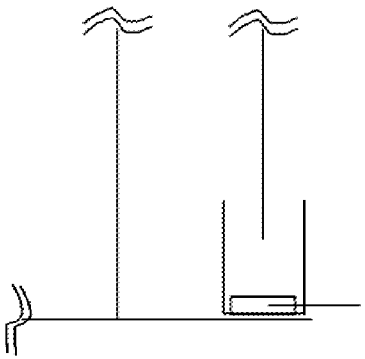
Figure 25:
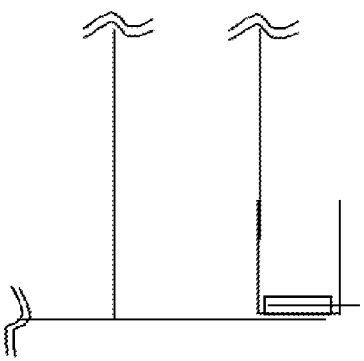
Figure 25:
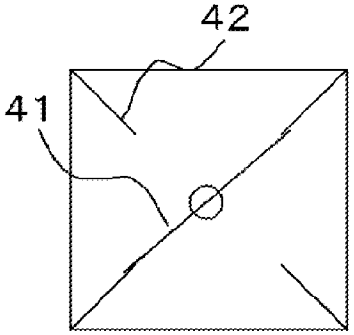
Figure 25:
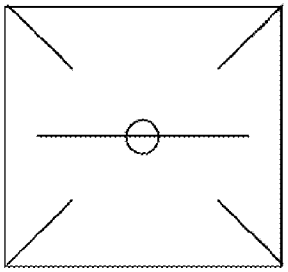
Figure 25:
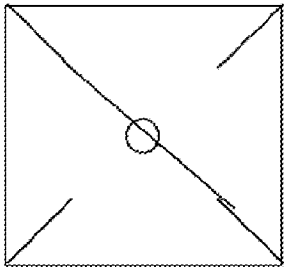
Figure 26:
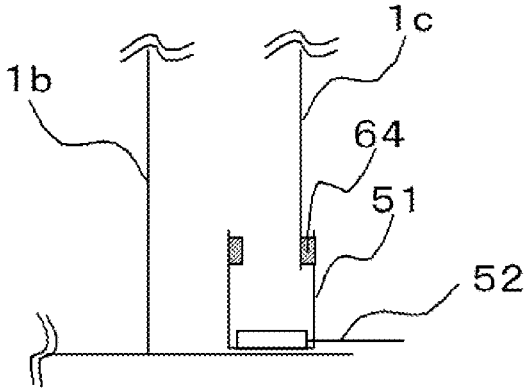
FIG. 26 is a cross sectional view illustrating an airtight sealing mechanism provided in the elevator apparatus according to Embodiment 5 of the present invention.

FIG. 24 is a perspective view illustrating a configuration of an elevator apparatus according to Embodiment 5 of the present invention. FIG. 25 is a set of cross sectional views each illustrating an operation of the elevator apparatus according to Embodiment 5 of the present invention, and FIG. 26 is a cross sectional view illustrating an airtight sealing mechanism provided in the elevator apparatus according to Embodiment 5 of the present invention.

First of all, the configuration of the elevator apparatus according to Embodiment 5 will be described with reference to FIG. 24. In FIG. 24, the elevator apparatus is provided with an airtight sealing mechanism 50, which is the airtight sealing means, in a space between the inner wall 1*b* and the outer wall 1*c* of the elevator car 1. Here, the inner wall 1*b*, located adjacent the airtight sealing mechanism 50, is constructed with a non-airtight wall, and the outer wall 1*c* is constructed with an airtight wall. The airtight sealing mechanism 50 includes an airtight sealing valve 51 that is rectangular C-shaped in cross section and provided slidably, a ball screw 52 attached to the airtight sealing valve 51, and the first gear 61 mounted on the ball screw 52. The first gear 61 is connected to the second gear 62 provided on the intake and exhaust air volume adjusting means 20 via the belt/chain 63. Rotational force of the motor 23 that drives the intake and exhaust air volume adjusting means 20 is transmitted via the belt/chain 63 to the first gear 61. The rotational movement is translated into linear movement via the ball screw 52, thereby sliding the airtight sealing valve 51. The configuration of the present embodiment is generally the same as that of Embodiment 4 except for such differences.

Next, an operation of the elevator apparatus according to the present embodiment with reference to FIG. 25.

FIG. 25(*a*1) is a view illustrating an operation of the airtight sealing mechanism 50 in which air is exhausted from the elevator car 1 at a maximum volume rate; FIG. 25(*a*2) is a view illustrating an operation of the intake and exhaust air volume adjusting means 20 in which the air is exhausted from the elevator car 1 at the maximum volume rate. FIG. 25(*b*1) is a view illustrating an operation of the airtight sealing mechanism 50 in which air is not drawn into the car 1 or exhausted therefrom; FIG. 25(*b*2) is a view illustrating an operation of the intake and exhaust air volume adjusting means 20 in which air is not drawn into the car 1 or exhausted therefrom. FIG. 25(*c*1) is a view illustrating an operation of the airtight sealing mechanism 50 in which air is drawn into the car 1 at a maximum volume rate; FIG. 25(*c*2) is a view illustrating an operation of the intake and exhaust air volume adjusting means 20 in which the air is drawn into the car 1 at the maximum volume rate.

In the present embodiment, in cases where the air volume adjusting plate 22 is in an abutting relation with the air volume adjusting stationary plates 24 as shown in FIGS. 25(*a*2) and 25(*c*2), the airtight sealing valve 51 is also in an abutting relation with the outer wall 1*c* of the car 1 as shown in FIGS. 25(*a*1) and 25(*c*1). On the other hand, in cases where the air volume adjusting plate 22 is not in an abutting relation with the air volume adjusting stationary plates 24 as shown in FIG. 25(*b*2), nor is the airtight sealing valve 51 in an abutting relation with the outer wall 1*c* as shown in FIG. 25(*b*1).

These relations allow the elevator car 1 to be airtight during periods when the air is drawn into and exhausted from the car 1 at the maximum volume rate and to be non-airtight during times other than those periods, therefore enabling the air effectively to be drawn into the car and exhausted therefrom at the maximum volume rate and also enabling the car 1 to be ventilated during times except during the period of the above operation.

When the air is exhausted from the car 1, the air pressure within the car 1 is negative relative to that thereoutside, causing the airtight sealing valve 51 to be attracted toward the left. Thus, the right portion of the airtight sealing valve 51 is facilitated to make intimate contact with the outer wall 1*c* of the car 1, which makes it easier to ensure the air-tightness of the car 1. Further, when the air is drawn into the car 1, the air pressure within the car 1 becomes higher than that thereoutside, causing the airtight sealing valve 51 to be pushed outwardly and thereby causing the left side portion of the airtight sealing valve 51 to make intimate contact with the outer wall 1*c* of the car 1, which facilitates ensuring the air-tightness between them.

Further, by adjusting a ratio of diameters between the first gear 61 and the second gear 62, the timing in which the car 1 becomes airtight can be adjusted as appropriate.

In addition, by also providing the sealing material 64, such as rubber or sponge, to the airtight sealing valve 51 as shown in FIG. 26, the timing in which the car 1 becomes airtight can be fine-adjusted and the air-tightness of the car 1 can also be improved.

According to the present embodiment, the airtight sealing mechanism 50 that achieves air-tightness of the car 1 is included and the air-tightness of the car 1 is thereby improved when the air is drawn into and exhausted from the car 1 at the maximum volume rate; therefore, the rotational speed of the air blower 3 can be relatively reduced and an elevator apparatus of low noise and less power consumption can thereby be provided.

According to the present embodiment, since the airtight sealing mechanism 50 achieves the air-tightness of the car 1 using power of the motor 23, which is means for driving the air volume adjusting plate 22, the air-tightness of the car 1 is achieved without providing separately a drive device that drives the airtight sealing movable valve 51, resulting in an elevator apparatus with less power consumption, less installation space and less cost.

In addition, according to the present embodiment, the differential pressure between the air pressure within the car 1 and that thereoutside can be used to improve the air-tightness between the outer wall 1*c* of the car 1 and an airtight sealing valve 51, which facilitates ensuring that the car 1 is airtight.

Embodiment 6

Figure 27:
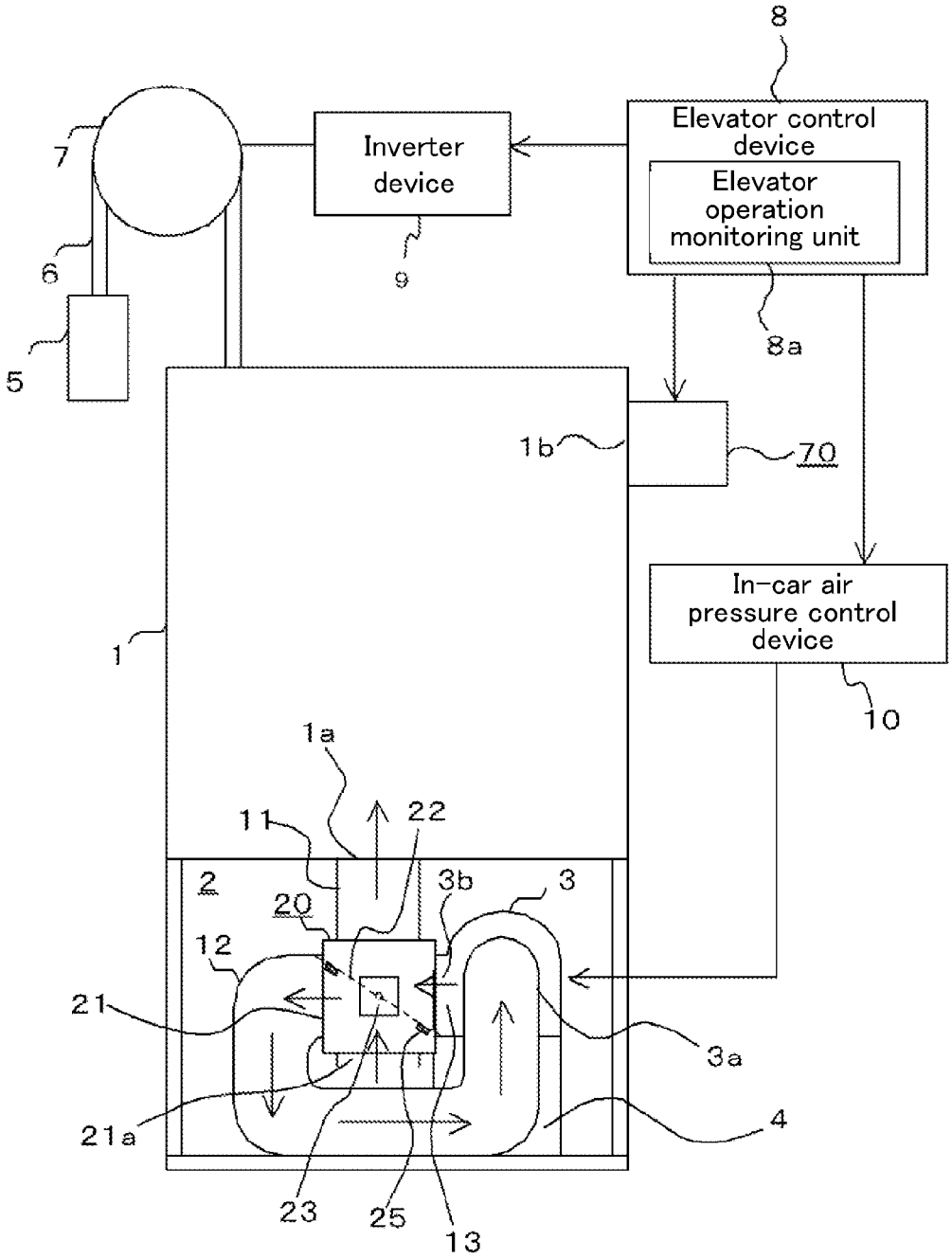
FIG. 27 is a schematic view illustrating a configuration of an elevator apparatus according to Embodiment 6 of the present invention.
Figure 28A:
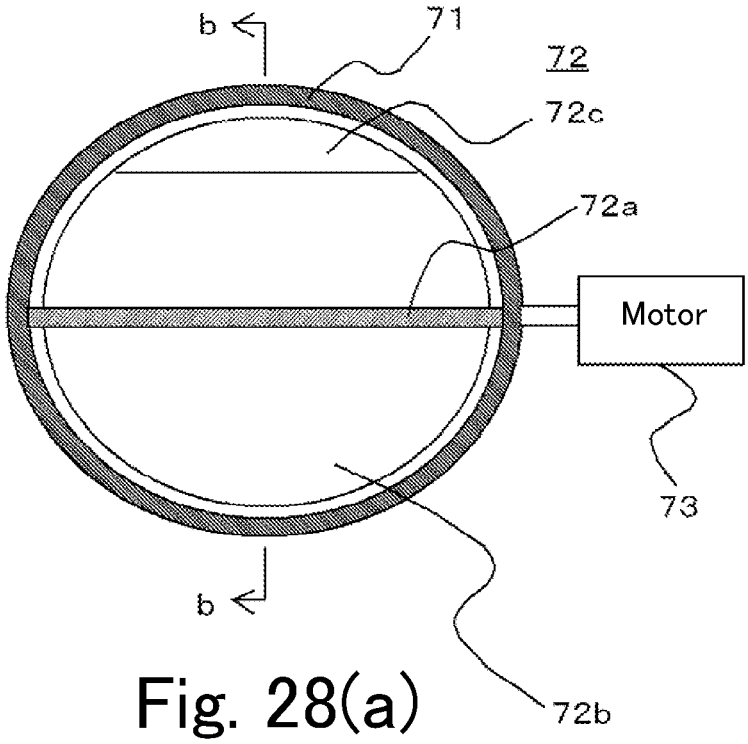
FIG. 28 shows a side and a cross sectional views illustrating an airtight sealing mechanism provided in the elevator apparatus according to Embodiment 6 of the present invention.
Figure 28B:
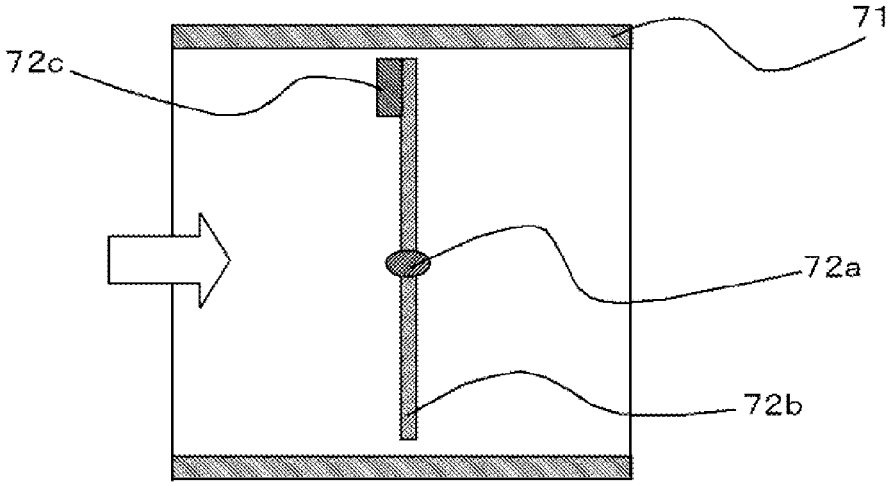
Figure 30:
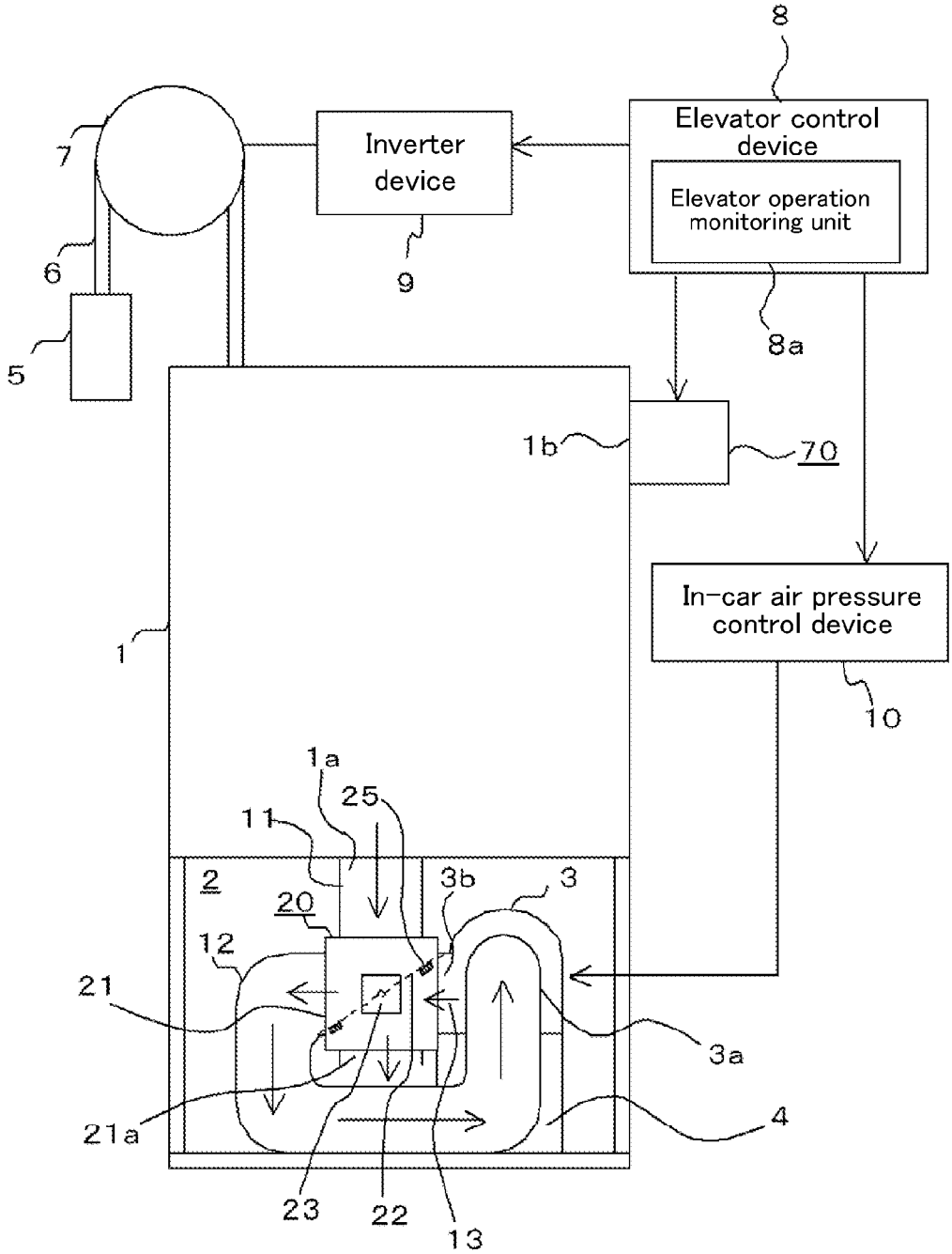
FIG. 30 is a schematic view illustrating an operation of the elevator apparatus according to Embodiment 6 of the present invention.
Figure 31:
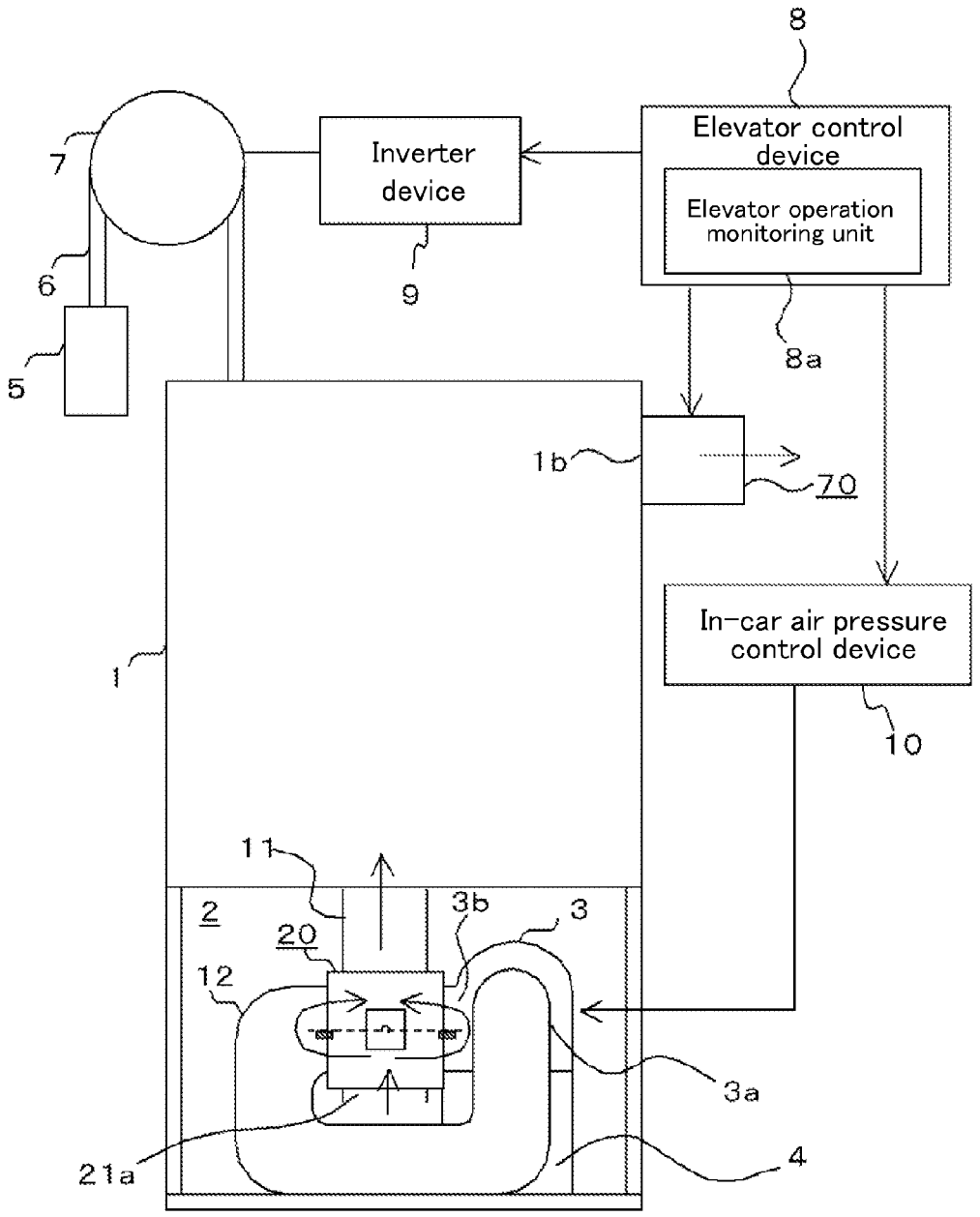
FIG. 31 is another schematic view illustrating an operation of the elevator apparatus according to Embodiment 6 of the present invention.

FIG. 27 is a schematic view illustrating a configuration of an elevator apparatus according to Embodiment 6 of the present invention. FIGS. 28(*a*) and 29(*a*) are side views illustrating a configuration of airtight sealing means in FIG. 27, and FIGS. 28(*b*) and 29(*b*) are cross-sectional views taken along lines b-b in FIGS. 28(*a*) and 29(*a*), respectively. FIGS. 30 and 31 are schematic views each illustrating an operation of the elevator apparatus according to Embodiment 6.

First of all, the configuration of the elevator apparatus according to Embodiment 6 will be described with reference to FIGS. 27 through 29.

In FIG. 27, provided inside the elevator control device 8 is an elevator operation monitoring unit 8*a* that monitors the operational status of the elevator, to detect abnormalities in the elevator operation, such as a power outage and a malfunction.

In addition, provided in the elevator car 1 is an airtight sealing mechanism 70 that is the airtight sealing means. The airtight sealing mechanism 70 is attached to a ventilation port 1*b* provided to the elevator car 1, and configured, as shown in FIGS. 28 and 29, with a ventilation duct 71, an open and close valve 72 provided rotatably to the ventilation duct 71, and a motor 73 that drives the open and close valve. The open and close valve 72 has a butterfly plate 72*b* attached to an shaft 72*a* that is fixed to the ventilation duct 71, and the butterfly plate 72*b* is formed elliptical in shape with its short axis in the direction perpendicular to the shaft. A cross section of the ventilation duct 71 is shaped conforming to the shape of the butterfly plate 72*b*, and a weight 72*c* is attached to one surface of the butterfly plate 72*b*.

Figure 29A:
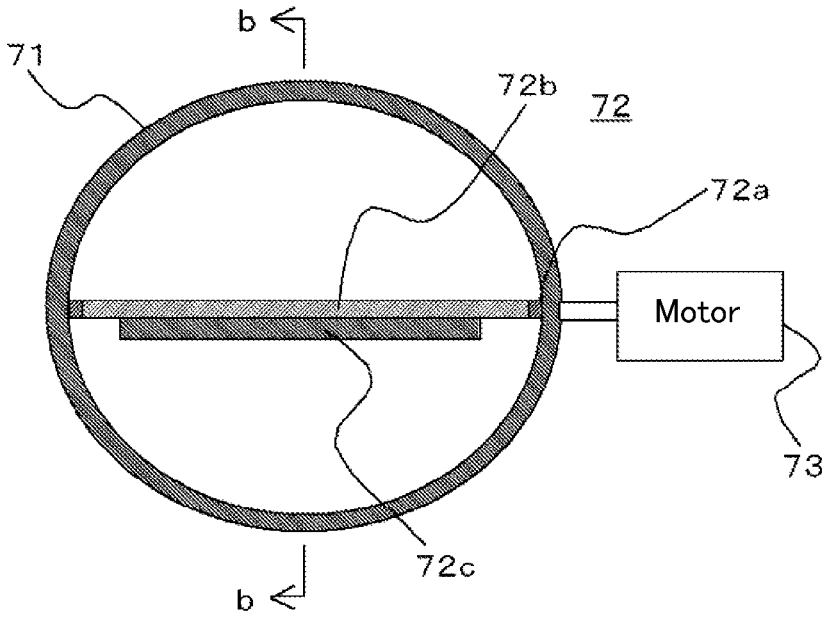
FIG. 29 shows another side and cross sectional view illustrating the airtight sealing mechanism provided in the elevator apparatus according to Embodiment 6 of the present invention.
Figure 29B:
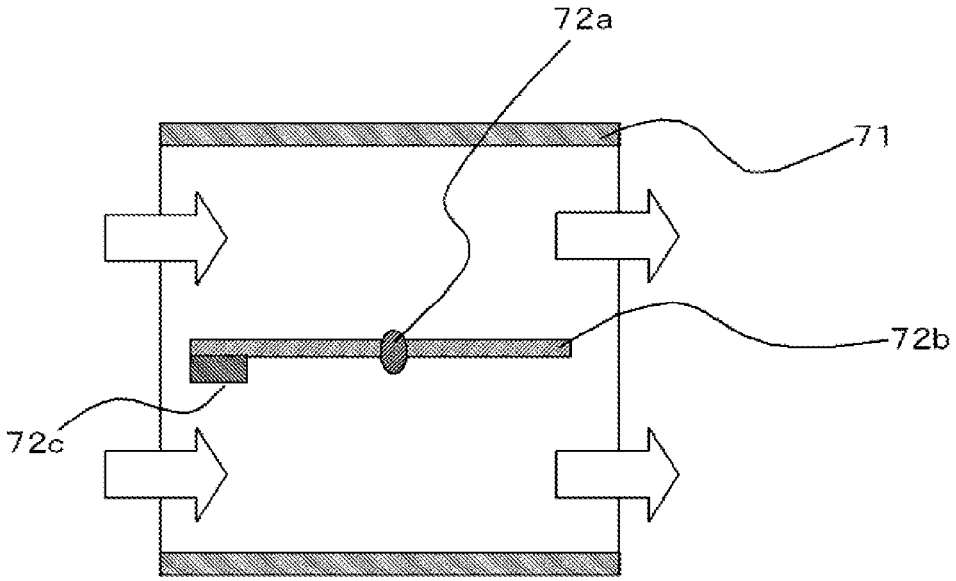

The drive of the motor 73 attached to the shaft 72*a* rotates the butterfly plate 72*b*, causing the open and close valve 72 to close with the plate 72*b* in a vertical position as shown in FIG. 28 and to open with the plate 72*b* in a horizontal position as shown in FIG. 29. In this way, closing the open and close valve 72 maintains the elevator car 1 in a very airtight condition, and opening the valve 72 causes an interior space of the car 1 to be in communication with an exterior space thereof. During normal operation of the elevator, the valve 72 is maintained in a closed condition.

The air volume adjusting plate 22, constituting the intake and exhaust air volume adjusting means 20, has weights 25 attached on its one surface. The positions where the weights 25 are attached to the adjusting plate 22 are determined so that the adjusting plate 22 is mechanically balanced to remain in a horizontal position.

The elevator apparatus according to the present embodiment has generally the same as that according to Embodiment 1 except for such differences.

The operation of the elevator apparatus according to the present embodiment will be described with reference to FIGS. 27 and 30.

When, during the operation of the elevator, the elevator operation monitoring unit 8*a* detects abnormalities, such as a power outage and a malfunction, the elevator control device 8 generates an output signal that causes the open and close valve 72 of the airtight sealing mechanism 70 to open. Then, in response to this signal, the motor causes the shaft 72*a* of the open and close valve to rotate, as shown in FIG. 29, so that the butterfly plate 72*b* is maintained in its horizontal position, thus ensuring the ventilation port within the elevator car 1 by making the space within the car 1 in communication with that thereoutside.

At the same time with this action, the elevator control device 8 produces to the in-car air pressure control device 10 an output signal for switching the air pressure adjusting device 2 from an air pressure adjustment mode operation to a ventilation mode operation. The in-car air pressure control device 10 after having received this signal controls the air blower 3 so as to rotate at a rotational speed required for the ventilation of the elevator car 1, and also controls the air volume adjusting plate 22 of the intake and exhaust air volume adjusting means 20 so that air is drawn therein at a maximum volume rate as shown in FIG. 27. By controlling the elevator apparatus in this manner, the air blower 3 of the air pressure adjusting device 2 plays a role of an air intake device and the ventilation duct 71 plays a role of an air exhaust device. That is, a ventilation system is configured such that its air intake portion provides mechanical ventilation and its air exhaust portion provides natural ventilation.

In this way, by switching the air pressure control device 10 from the air pressure adjustment mode operation of the elevator car 1 to the ventilation mode operation thereof when the elevator operation monitoring unit 8*a* detects an abnormal operation of the elevator, a ventilation path within the car 1 can be established during the abnormal operation, thus enabling ventilation of the car 1 even in the event of a passenger(s) being trapped within the car 1.

Here, the orientation of the air volume adjusting plate 22 during ventilation mode operation may be controlled so that air is being exhausted at a maximum volume rate as shown in FIG. 30. By controlling its orientation in this way, the air blower 3 of the air pressure adjusting device 2 plays a role of an air-exhausting device, with the ventilation duct 71 playing a role of an air intake device. That is, a ventilation system is configured such that its air intake portion provides natural ventilation and its air exhaust portion, mechanical ventilation.

The open and close valve 72 is controlled to be closed during normal operation of the elevator; however, the butterfly plate 72*b*, constituting the open and close valve 72, has the weight 72*c* attached to one surface of the plate 72*b*. Therefore, when a power supply to the elevator car 1 is interrupted by a power outage and the like, the weight 72*c* rotates the shaft 72*a*, causing the butterfly plate 72*b* to be automatically in a horizontal position as shown in FIG. 29, thus opening the open and close valve 72 mechanically. In this way, in the event that the power supply to the elevator car 1 is interrupted to stop the operation of the air pressure adjusting device 2, the ventilation path within the elevator car 1 can be established.

Further, the air volume adjusting plate 22, constituting the intake and exhaust air volume adjusting means 20, has the weight 25 attached on its one surface, and its mechanically balanced position is determined to be in the horizontal position; therefore, in cases where the power supply to the intake and exhaust air volume adjusting means 20 is interrupted, the adjusting plate 22 is automatically maintained in the horizontal position as shown in FIG. 31, thus forming a ventilation path through which the space within the car 1 is in communication with that thereoutside, not by way of the air blower 3. Consequently, even when the power supply to the elevator car 1 is interrupted to shut down the blower 3, a natural ventilation system is available to ensure a minimum volume of the ventilation.

In this way, when the power supply to the elevator car 1 is interrupted, both the open and close valve 72 and the intake and exhaust air volume adjusting means 20 are configured to be mechanically opened, thus establishing the ventilation path within the car 1.

In the present embodiment, the open and close valve 72 and the air volume adjusting plate 22 have the weights 72*c* and 25 on only respective ones of their surfaces, respectively; however, the elevator apparatus may be configured such that torsion springs are mounted on the shaft 72*a* of the open and close valve and the shafts of the air volume adjusting plate 22, and when the power supply to the elevator car 1 is interrupted, torsion spring force of the torsion spring causes the butterfly 72*b* and the air volume adjusting plate 22 to be in the horizontal position, thus opening mechanically the open and close valve 72 and the air volume adjusting plate 22.

Further, in the present embodiment, both the open and close valve 72 and the air volume adjusting plate 22 are configured to be mechanically opened when the power supply to the elevator car 1 is interrupted; however, either the open and close valve 72 or the air volume adjusting plate 22 may be configured to be mechanically opened.

As described above, according to the present embodiment, the elevator apparatus further comprises the elevator operation monitoring unit 8*a* that monitors the operation of the car 1 and when this elevator operation monitoring unit 8*a* detects an abnormal operation, the airtight sealing mechanism 70 is activated so that the interior space of the car 1 communicates with the exterior space thereof, thus ensuring a ventilation port of the car 1 during the abnormal operation.

According to the present embodiment, the airtight sealing mechanism 70 is closed during the actuation of the intake and exhaust air volume adjusting means 20, thus enabling the air-tightness of the car 1 to be improved during the adjustment of air pressure within the car 1, achieving a reduction in the size of the air blower 3 constituting the intake and exhaust air volume adjusting means 20.

In addition, according to the present embodiment, the open and close valve 72 constituting the airtight sealing mechanism 70 is made up of a rotatable flat plate shaped member, and is opened when the power supply to the elevator car 1 is interrupted; thus, the ventilation path within the car 1 can be established even during power outage.

Moreover, according to the present embodiment, the air volume adjusting plate 22 constituting the intake and exhaust air volume adjusting means 20 is stopped at a position where air within the car 1 is in communication with that outside the car 1, not by way of the air blower 3, when the power supply to the elevator car 1 is interrupted; therefore, the ventilation path to the elevator car 1 can be established even during power outage.

Embodiment 7

Figure 32:
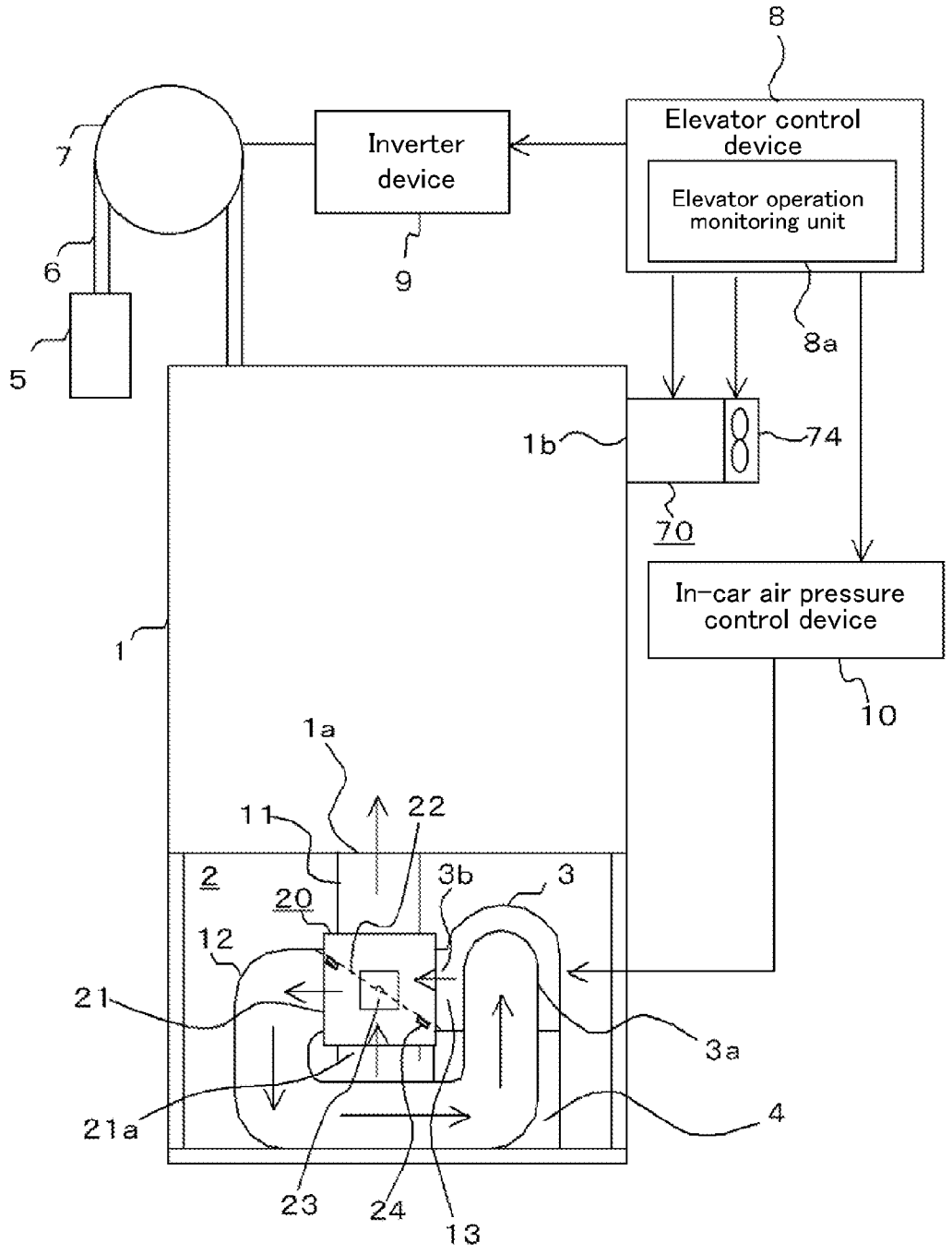
FIG. 32 is a schematic view illustrating a configuration of an elevator apparatus according to Embodiment 7 of the present invention.

FIG. 32 is a schematic view illustrating a configuration of an elevator apparatus according to Embodiment 7 of the present invention.

In FIG. 32, the elevator apparatus includes a ventilation fan 74 located within the ventilation duct 71 constituting the airtight sealing mechanism 70 and adjacent the open and close valve 72. The configuration of the elevator apparatus according to the present embodiment is generally the same as that of Embodiment 6 except for such difference.

Next, an operation of the elevator apparatus according to the present embodiment will be described.

During normal operation of the elevator, the open and close valve 72 is maintained in a closed condition, and the ventilation fan 74 is maintained in a stopped condition.

When the elevator operation monitoring unit 8*a* detects an abnormal operation during the elevator operation, the elevator control device 8 produces an output signal that causes the open and close valve 72, which is the same as in Embodiment 6, to be open, and also generates an output signal that causes the ventilation fan 74 to be in operation. At the same time with those output signals, the elevator control device 8 produces to the in-car air pressure control device 10 an output signal for switching from air pressure adjustment mode operation to ventilation mode operation. As with Embodiment 6, the in-car air pressure control device 10, after having received this signal, controls the air blower 3 so as to rotate at a rotational speed required for the ventilation within the elevator car 1 and also controls the air volume adjusting plate 22 of the intake and exhaust air volume adjusting means 20 to be at the position where the air is drawn at the maximum volume rate as shown in FIG. 32. By controlling the adjusting plate 22 in this manner, the air blower 3 of the air pressure adjusting device 2 plays a role of the air intake device and the ventilation fan 74 plays a role of the air exhaust device. That is, a ventilation system is configured such that its air intake portion and also its air exhaust portion provide mechanical ventilation.

The orientation of the air volume adjusting plate 22 during the ventilation mode operation may be controlled so that air is exhausted at the maximum volume rate as shown in FIG. 30. By controlling the orientation in this way, the air blower 3 of the air pressure adjusting device 2 plays a role of the air exhausting device and the ventilation fan 74 plays a role of the air intake device. Also in this case, a ventilation system is configured such that its air intake portion and its air exhaust portion provide mechanical ventilation.

According to the present embodiment, since the airtight sealing mechanism 70 includes the ventilation fan 74 located adjacent the open and close valve 72, both drawing-in and exhausting of air is performed by the mechanical ventilation, therefore enabling the elevator car 1 to be ventilated more efficiently during an abnormal operation.

Embodiment 8

Figure 33:
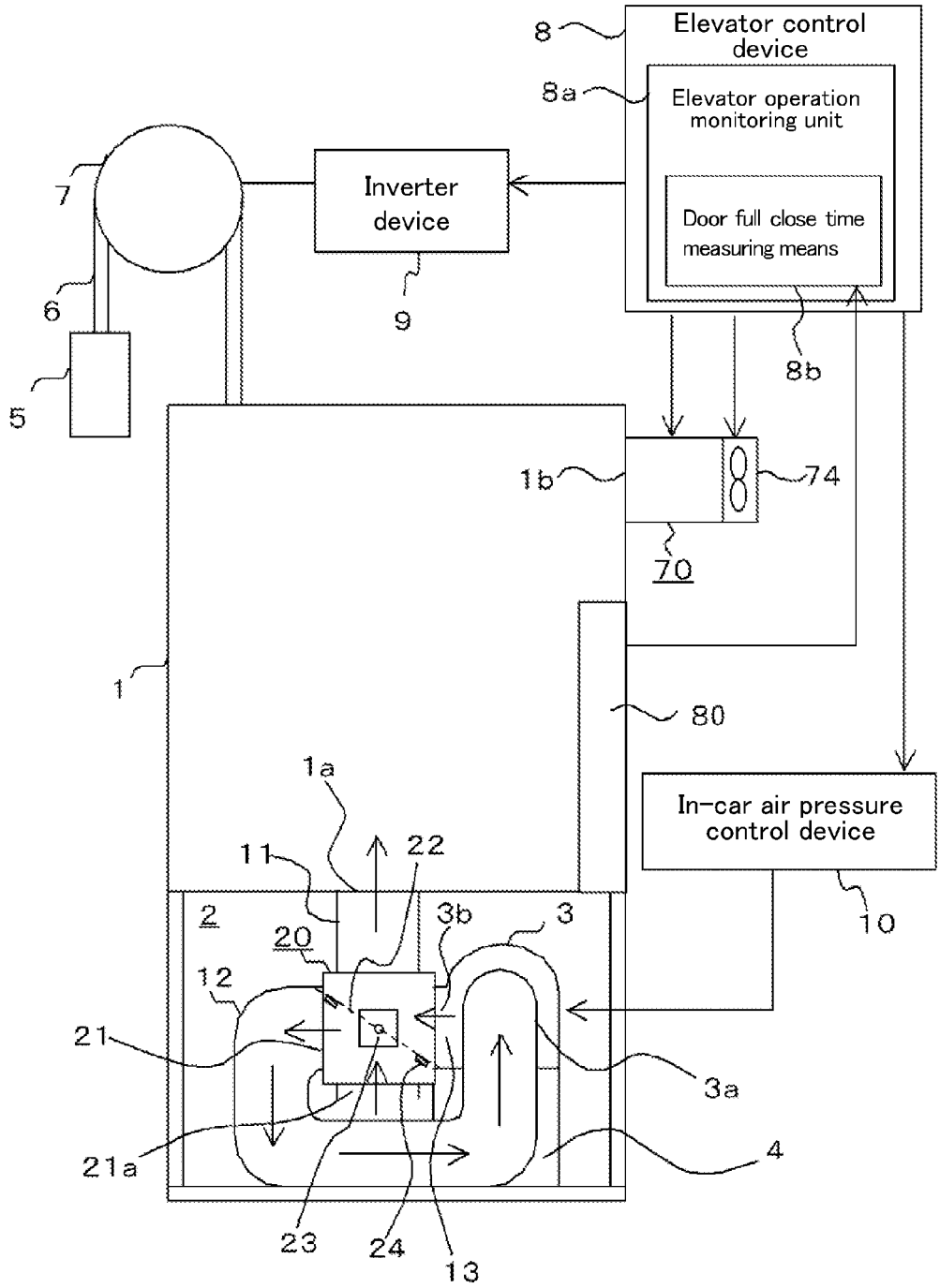
FIG. 33 is a schematic view illustrating a configuration of an elevator apparatus according to Embodiment 8 of the present invention.

FIG. 33 is a schematic view illustrating a configuration of an elevator apparatus according to Embodiment 8 of the present invention.

In FIG. 33, the elevator operation monitoring unit 8*a* of the elevator apparatus includes door full close time measuring means 8*b* that measures a period of time during which a device for entering and exiting the elevator car, designated by numeral 80—a door for a passenger(s) to enter and exit the elevator car 1—is fully closed. The configuration of the elevator apparatus according to the present embodiment is generally the same as that according to Embodiment 7 except for such difference.

Next, the operation of the elevator apparatus according to the present embodiment will be described.

The door full close time measuring means 8*b* measures the period of time during which the device for entering and exiting an elevator car, 80, of the elevator car 1 is fully closed with the upward and downward movement of the car 1 being stopped. If a measured time by the door full close time measuring means 8*b* exceeds a predetermined time, the elevator control device determines that an abnormal operation of the elevator occurs, and operates in the same fashion as in Embodiment 7. The predetermined time is set to a longer period than the longest full close time in a normal operation of the elevator—such as, for instance, a period obtained by adding a surplus time to a period of time elapsing for the elevator to move from the top floor to the bottom floor or vice versa.

Then, when the abnormal condition of the elevator is removed and the elevator car 1 restarts on its upward and downward movement, the open and close valve 72, constituting the airtight sealing mechanism 70, is closed so that the car 1 becomes very airtight.

In the event that the door full close time measuring means 8*b* measures the full close time of the device for entering and exiting an elevator car, 80, means for ascertaining the presence or absence of a passenger(s) within the car 1 is provided; when the presence of the passenger is detected, preferably, the elevator apparatus determines that the abnormal operation has occurred, causing the car 1 to be ventilated, and when the presence of the passenger(s) is not detected, preferably, the apparatus determines that the abnormal operation has not occurred, but mere stopping condition has occurred, causing the car 1 to be maintained very airtight without ventilation. For instance, a weighing scale disposed in the car 1 (a device for weighing the weight of an object within the car 1) is used as the means for ascertaining the presence or absence of a passenger(s) within the car 1, and when the weighing scale weighs a weight heavier than the predetermined weight, the presence of the passenger(s) can be detected within the car 1.

According to the present embodiment, the elevator operation monitoring unit 8*a* includes the door full close time measuring means 8*b* that measures the time during which the device for entering and exiting an elevator car, 80, is being fully closed when the car 1 stops its upward or downward travel, and since the monitoring unit 8*a* is configured such that when the period of time measured by the door full close time measuring means 8*b* exceeds a predetermined period of time, an abnormal operation of the car 1 is detected, a trapped passenger(s) in the car 1 can positively be detected to ventilate the car 1.

INDUSTRIAL APPLICABILITY

The present invention is applicable to elevator apparatuses and the like that is to be installed in a building having a long upward and downward travel of an elevator car.

What is claimed is:

1. An elevator apparatus comprising:

an elevator car that moves upward and downward;

an air blower that includes an air inlet and an air outlet;

a plurality of ducts including a first duct having one end connected to the elevator car, a second duct having one end connected to the air inlet of the air blower, and a third duct having one end connected to the air outlet of the air blower;

an intake and exhaust air flow adjuster which adjusts intake flow to and exhaust flow from the elevator car in respective modes through the first duct by varying a flow of air that bypasses the elevator car, the bypass flow flowing from the air outlet of the air blower through the intake and exhaust air flow adjuster to the air inlet of the air blower, the intake and exhaust air flow adjuster comprising a plurality of ports, wherein three of the plurality of ports are connected to another end of each of the first duct, the second duct and the third duct, respectively, and the plurality of ports includes a fourth port in direct fluid communication with ambient; and a controller that controls the intake and exhaust air flow adjuster, to control an air pressure within the elevator car to a set air pressure.

2. The elevator apparatus as recited in claim 1, wherein the intake and exhaust air flow adjuster further comprises:

a space separator provided rotatably within the intake and exhaust air flow adjuster, which separates an inside space within the intake and exhaust air flow adjuster into a first space in communication with the elevator car and a second space in communication with the fourth port, and a driver that drives the space separator.

3. The elevator apparatus as recited in claim 1, wherein the air blower rotates at a uniform rotational speed.

4. The elevator apparatus as recited in claim 1, wherein the controller further controls the rotational speed of the air blower, to make switching, according to a differential pressure between the set air pressure within the elevator car and the ambient air pressure, between an adjustment of the intake flow and exhaust flow of air by controlling the rotational speed of the air blower and an adjustment of the intake flow and exhaust flow of air by controlling the intake and exhaust air flow adjuster.

5. The elevator apparatus as recited in claim 1, further comprising an airtight seal that achieves air-tightness of the elevator car.

6. The elevator apparatus as recited in claim 5, wherein the airtight seal is actuated by driving power of the driver.

7. The elevator apparatus as recited in claim 5, further comprising an elevator operation monitor that monitors an operating condition of the elevator car, wherein when the elevator operation monitor detects an abnormal operation of the car, the airtight seal is activated so that an area within the car communicates with an area outside the car.

8. The elevator apparatus as recited in claim 7, wherein the elevator operation monitor includes a door full close timer that measures a period of time elapsing until a door of the elevator car fully closes when the car stops its upward or downward travel, and detects an abnormal operation when a period of time measured by the door full close timer exceeds a predetermined period of time.

9. The elevator apparatus as recited in claim 5, wherein the airtight seal includes an open and close valve that closes during activation of the intake and exhaust air flow adjuster.

10. The elevator apparatus as recited in claim 9, wherein the airtight seal includes a fan provided adjacent the open and close valve.

11. The elevator apparatus as recited in claim 9, wherein the open and close valve mechanically opens when a power supply to the elevator car is interrupted.

12. The elevator apparatus as recited in claim 11, wherein the space separator stops at a position in which the second space within the elevator car communicates with the outside space there outside, without an intervening air blower, when the power supply to the elevator car is interrupted.

13. The elevator apparatus as recited in claim 1, wherein the intake and exhaust air flow adjuster further comprises:

a space separator provided movably within the intake and exhaust air flow adjuster; and a driver that drives the space separator, wherein a position of the space separator is controlled by the driver so that a conductance of air through a passage where the interior air intake and exhaust port communicates with the fourth port varies in synchronism with a conductance of air through a passage where the air inlet of the air blower communicates with the air outlet of the air blower.

14. The elevator apparatus as recited in claim 13, wherein when a maximum volume of air is drawn into the elevator car, the position of the space separator is controlled to separate an inside space within the intake and exhaust air flow adjuster so that the air outlet of the air blower communicates with a first port of the plurality of ports, the air inlet of the air blower communicates with the fourth port, and the air inlet of the air blower does not communicate with the air outlet of the air blower; and when a maximum volume of air is exhausted from the elevator car, the position of the space separator is controlled to separate the inside space within the intake and exhaust air flow adjuster so that the air inlet of the air blower communicates with the first port, the air outlet of the air blower communicates with the fourth port, and the air inlet of the air blower does not communicate with the air outlet of the air blower.

* * * * *